US007845786B2

(12) United States Patent
Konno

(10) Patent No.: US 7,845,786 B2
(45) Date of Patent: Dec. 7, 2010

(54) IMAGE FORMING APPARATUS AND EJECTION STATE DETERMINATION METHOD

(75) Inventor: Masaaki Konno, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 513 days.

(21) Appl. No.: 11/520,805

(22) Filed: Sep. 14, 2006

(65) Prior Publication Data

US 2007/0064077 A1 Mar. 22, 2007

(30) Foreign Application Priority Data

Sep. 16, 2005 (JP) ..... 2005-270876

(51) Int. Cl.

| | |
|---|---|
| ***B41J 2/01*** | (2006.01) |
| ***B41J 29/38*** | (2006.01) |
| ***B41J 29/393*** | (2006.01) |
| ***B41J 2/015*** | (2006.01) |

(52) U.S. Cl. ..... 347/102; 347/9; 347/19; 347/21

(58) Field of Classification Search ..... 347/101, 347/102, 19, 14, 21, 9, 16; 101/488; 219/216; 346/25

See application file for complete search history.

(56) References Cited

U.S. PATENT DOCUMENTS

| | | | | |
|---|---|---|---|---|
| 5,600,350 | A * | 2/1997 | Cobbs et al. | 347/19 |
| 5,635,969 | A * | 6/1997 | Allen | 347/96 |
| 5,724,152 | A * | 3/1998 | Hayashi et al. | 358/296 |
| 5,796,414 | A * | 8/1998 | Sievert et al. | 347/19 |
| 5,898,443 | A * | 4/1999 | Yoshino et al. | 347/19 |
| 6,312,082 | B1 * | 11/2001 | Lund et al. | 347/19 |
| 6,378,976 | B1 * | 4/2002 | Byers et al. | 347/19 |
| 6,477,950 | B1 * | 11/2002 | Feilen et al. | 101/230 |
| 2004/0001134 | A1 * | 1/2004 | Nakazawa et al. | 347/101 |
| 2004/0196322 | A1 * | 10/2004 | Nakajima et al. | 347/14 |
| 2005/0062782 | A1 * | 3/2005 | Endo et al. | 347/19 |
| 2005/0073547 | A1 * | 4/2005 | Endo | 347/19 |
| 2005/0146544 | A1 * | 7/2005 | Kondo | 347/7 |
| 2006/0158472 | A1 * | 7/2006 | Endo | 347/14 |

FOREIGN PATENT DOCUMENTS

| | | | |
|---|---|---|---|
| JP | 2000-168106 | A | 6/2000 |
| JP | 2001-226618 | A | 8/2001 |
| JP | 2002-146254 | A | 5/2002 |
| JP | 2004-276314 | A | 10/2004 |
| JP | 2004-314362 | A | 11/2004 |

* cited by examiner

*Primary Examiner*—Stephen D Meier
*Assistant Examiner*—Leonard S Liang
(74) *Attorney, Agent, or Firm*—Birch, Stewart, Kolasch & Birch, LLP

(57) ABSTRACT

The image forming apparatus comprises: an ink ejection device which ejects ink through nozzles, the ink containing coloring material; a treatment liquid ejection device which ejects treatment liquid through nozzles, the treatment liquid being a colorless transparent liquid containing infrared-absorbing material and having at least one of an action of insolubilizing the coloring material, an action of aggregating the coloring material, and an action of preventing dispersion of the coloring material; an infrared irradiating device which irradiates infrared light onto the treatment liquid having been ejected from the treatment liquid ejection device; and a treatment liquid determination device which includes a photoelectric transducer having sensitivity to the infrared light.

5 Claims, 10 Drawing Sheets

IMAGE FORMING APPARATUS AND EJECTION STATE DETERMINATION METHOD

BACKGROUND OF THE INVENTION

1. Field of the Invention

The present invention relates to an image forming apparatus and an ejection state determination method, and more particularly to image formation technology and liquid ejection state determination technology, suitable for an inkjet recording apparatus which forms images of high quality on a recording medium by using ink containing a coloring material, and a treatment liquid.

2. Description of the Related Art

In the field of inkjet printing technology, methods which conjointly use an ink containing coloring material and a treatment liquid, in order to form images of high quality, are known. In the method using the treatment liquid, it is necessary to make the treatment liquid and the ink react reliably on the recording medium, and therefore, if the treatment liquid is not deposited or if there is deviation between the application positions (the deposition positions) of the ink and the treatment liquid, then the effect of the treatment liquid is not obtained sufficiently. In response to these problems, various technologies have been proposed with a view to determining the ejection of transparent treatment liquid (see Japanese Patent Application Publication Nos. 2000-168106, 2004-276314, and 2004-314362).

Japanese Patent Application Publication No. 2000-168106 discloses technology which uses an ejection test film as a device for testing the ejection state of a colorless transparent treatment liquid. Japanese Patent Application Publication No. 2004-276314 discloses technology for recording a test pattern by combining with another type of liquid, as technology for confirming the ejection from nozzles which eject liquid that is not readily visible. Japanese Patent Application Publication No. 2004-314362 discloses technology for detecting missing dots of liquid that is not readily visible, on the basis of the difference in the degree of scattering of the light occurring due to the microscopic surface state of the recording medium.

On the other hand, Japanese Patent Application Publication No. 2001-226618 discloses technology relating to ink having spectral absorption in the infrared region, and discloses a drying method where heating is performed by applying infrared light, after printing. Japanese Patent Application Publication No. 2002-146254 discloses technology for providing an invisible pattern made of an infrared absorbing material, with a view to design restrictions of a printed object or forgery prevention of same.

Japanese Patent Application Publication No. 2000-168106 discloses the method using the ejection test film which changes color due to the treatment liquid, as technology for determining the ejection state of the transparent treatment liquid, but it requires the use of a special medium for the purpose of test (i.e. the ejection test film). The method disclosed in Japanese Patent Application Publication No. 2004-276314 has a problem in that determination is instable, due to the circumstances of the combination with a different type of liquid. The method disclosed in Japanese Patent Application Publication No. 2004-314362 requires a detector which is capable of high-precision adjustment of the light path, and high-sensitivity determination.

Japanese Patent Application Publication No. 2001-226618 discloses technology which promotes drying by including the infrared absorbing material in the ink containing the coloring material, but it does not disclose technology relating to a transparent treatment liquid used in a two-liquid reaction system. Japanese Patent Application Publication No. 2002-146254 discloses the printing of the invisible pattern by including the infrared absorbing material in the ink, but it simply deals with the issue of providing the invisible pattern by means of the specific material, and it does not discuss the concept of using infrared absorption in the promotion of drying, the determination of the ejection state, or the like.

SUMMARY OF THE INVENTION

The present invention has been contrived in view of the foregoing circumstances, an object thereof being to provide technology for determining the ejection state of nozzles which eject a transparent liquid by means of a simple technique, and to provide an image forming apparatus and an ejection state determination method whereby a reliable two-liquid reaction can be achieved between a transparent treatment liquid and an ink including a coloring material.

In order to attain the aforementioned object, the present invention is directed to an image forming apparatus, comprising: an ink ejection device which ejects ink through nozzles, the ink containing coloring material; a treatment liquid ejection device which ejects treatment liquid through nozzles, the treatment liquid being a colorless transparent liquid containing infrared-absorbing material and having at least one of an action of insolubilizing the coloring material, an action of aggregating the coloring material, and an action of preventing dispersion of the coloring material; an infrared irradiating device which irradiates infrared light onto the treatment liquid having been ejected from the treatment liquid ejection device; and a treatment liquid determination device which includes a photoelectric transducer having sensitivity to the infrared light.

In principle, the droplet ejection results of a colorless transparent liquid are not readily visible. According to the present invention, since the treatment liquid containing the infrared-absorbing material, which absorbs infrared light irradiated by the infrared irradiating device, is used, then it is possible to recognize the ejection results by means of the photoelectric transducer having sensitivity to the infrared light. Therefore, it is possible readily to determine the ejection state of the treatment liquid ejection device (for example, ejection failures, ejection direction abnormalities, ejection volume abnormalities, and the like).

Preferably, the image forming apparatus further comprises a test pattern formation control device which controls the treatment liquid ejection device to eject the treatment liquid to form a prescribed test pattern onto one of a recording medium and an intermediate transfer body by depositing the treatment liquid, wherein the photoelectric transducer determines a formation state of the prescribed test pattern.

According to this aspect of the present invention, when determining the ejection state of the treatment liquid, by printing a prescribed test pattern and determining the printing state of the prescribed test pattern by means of the photoelectric transducer, it is possible to improve determination accuracy in comparison with determination on the basis of an actual image.

Preferably, the image forming apparatus further comprises a drying promotion device which promotes drying of a recording medium by irradiating infrared light onto the recording medium, the treatment liquid ejected from the treatment liquid ejection device and the ink ejected from the ink ejection device having been deposited on the recording medium.

According to this aspect of the present invention, since the thermal absorption efficiency is increased due to the infrared absorbing function of the treatment liquid, and hence drying of the recording medium after droplet ejection can be promoted, then it is possible to carry out fixing in a short period of time, and therefore, high-speed printing can be achieved.

Preferably, the image forming apparatus further comprises a treatment liquid ejection defect judgment device which judges a number and positions of defective ones of the nozzles of the treatment liquid ejection device according to a determination signal obtained from the photoelectric transducer of the treatment liquid determination device.

If there is a defective ejection nozzle (a nozzle that is not capable of ejection), then treatment liquid cannot be deposited at the position where droplet deposition is originally intended for that nozzle, and hence the print results of the treatment liquid vary, depending on the presence or absence of a defective nozzle. According to this aspect of the present invention, since the determination signal obtained from the photoelectric transducer is a signal which corresponds to the printing state, then it is possible to determine the positions and number of defective nozzles by processing the determination signal.

Preferably, the image forming apparatus further comprises an image processing device which specifies a deposition arrangement of the ink in such a manner that usage rate for the nozzle of the ink ejection device corresponding to the position of the defective nozzle of the treatment liquid ejection device is reduced.

According to this aspect of the present invention, the defective deposition positions of the treatment liquid are identified, and the droplet deposition arrangement (dot arrangement) of the ink is corrected and the ink droplet ejection is controlled accordingly, in such a manner that the ink deposition volume onto the positions, where there is insufficient treatment liquid, is reduced. Consequently, it is possible to suppress deterioration of image quality caused by treatment liquid ejection defects, and hence high-quality image formation can be achieved.

For example, droplet deposition arrangement data is obtained by correcting the image data on the basis of the information on the ejection defect nozzle positions of the treatment liquid ejection device, in order to suppress the occurrence of streak-shaped density non-uniformities corresponding to these ejection defect positions, and then performing halftoning of the corrected data. By controlling droplet ejection of the ink ejection head in accordance with the droplet deposition arrangement data obtained in this way, it is possible to achieve satisfactory image formation.

Preferably, the image forming apparatus further comprises a first restoration control device which performs control for carrying out a maintenance operation for restoring ejection performance of the treatment liquid ejection device when the number of the defective nozzles of the treatment liquid ejection device exceeds a first threshold value.

According to this aspect of the present invention, when the number of defective nozzles has exceeded a tolerable value, then a maintenance operation is carried out. Therefore, it is possible to achieve a reliable two-liquid reaction. Furthermore, it is also possible to reduce the number of maintenance operations carried out to the minimum required number, and therefore, print productivity can be improved.

Here, a "maintenance operation" is, for example, preliminary ejection, nozzle suctioning, wiping of the nozzle surface, or a suitable combination of these.

Preferably, the image forming apparatus further comprises an ink determination device which includes a photoelectric transducer having sensitivity to visible light; an ink ejection defect judgment device which judges a number and positions of defective ones of the nozzles of the ink ejection device according to a determination signal obtained from the photoelectric transducer of the ink determination device; and a second restoration control device which performs control for carrying out a maintenance operation for restoring ejection performance of the ink ejection device when the number of the defective nozzles of the ink ejection device exceeds a second threshold value smaller than the first threshold value.

According to this aspect of the present invention, similarly to the device which determines the ejection state of the treatment liquid ejection device, a device for determining the ejection state of the ink ejection device (ink determination device) is also provided, and a maintenance operation of the ink ejection device is carried out in accordance with the number of defective ejection nozzles determined by the ink determination device. Since the colored ink has greater visibility than the colorless transparent treatment liquid, and hence has a greater effect on the image quality, then the tolerable number of defective nozzles of the ink ejection device is smaller than the tolerable number of defective nozzles of the treatment liquid ejection device. Therefore, the threshold value (second threshold value) at which the requirement for implementation of a maintenance operation (restoration processing) is judged for the ink ejection device is set to a lower value than the threshold value (first threshold value) at which the requirement for implementation of a maintenance operation (restoration processing) is judged for the treatment liquid ejection device. In other words, the first threshold value is set to a greater value than the second threshold value.

Preferably, the image forming apparatus further comprises a recording medium type identification device which identifies a type of the recording medium; and a threshold value setting device which sets the first threshold value and/or the second threshold value according to the type of the recording medium.

Since the permeation of the liquid or the behavior of the liquid droplets deposited on the recording medium varies depending on conditions such as the type and thickness of the recording medium, the dielectric constant thereof, and so on, then the type of the recording medium is, desirably, determined by means of a recording medium type determination device, and the first threshold value and the second threshold value are set in accordance with the type of the recording medium. Therefore, it is possible to form images under optimal conditions in relation to the type of recording medium.

For example, when using a medium of high permeability (a permeable medium), the tolerable number of defective nozzles is set to a large number, thus prioritizing print productivity. On the other hand, when using a medium of low permeability (a non-permeable medium or a low-permeability medium), image quality is prioritized, and the tolerable number of defective nozzles is set to a smaller number.

The recording medium type identification device may comprise, for example, a device which measures the reflectivity of the recording medium, or a device which reads in the type of the recording medium used from the ID, or the like, of the supply magazine. Furthermore, the recording medium type identification device is not limited to a device which obtains information automatically by means of sensors, an information reading device, or the like, and it may also be constituted in such a manner that information relating to the type of recording medium or the like is input by a user by means of a prescribed input apparatus (user interface), or the like.

For the treatment liquid ejection device in the image forming apparatuses according to the present invention, it is suitable to use, for example, an inkjet type of ejection head which ejects treatment liquid in the form of liquid droplets. Furthermore, for the ink ejection device, it is suitable to use an inkjet liquid droplet ejection head which ejects ink on the basis of image information for printing (print data).

The inkjet recording apparatus according to one mode of the image recording apparatus of the present invention comprises: a liquid ejection head (corresponding to an "ink ejection device" or "treatment liquid ejection device") having a liquid droplet ejection element row in which a plurality of liquid droplet ejection elements are arranged in a row, each liquid droplet ejection element comprising a nozzle for ejecting an ink droplet (or treatment liquid droplet) in order to form a dot, and a pressure generating device (piezoelectric element, heating element, or the like) which generates an ejection pressure; and a droplet ejection control device which controls the ejection of liquid droplets from the liquid ejection head on the basis of droplet ejection arrangement data generated from the image data. An image is formed on a recording medium by means of the liquid droplets ejected from the nozzles.

One compositional embodiment of a liquid ejection head used in a treatment liquid ejection device of an ink ejection device is a full line type head in which a plurality of nozzles are arranged through a length corresponding to the full width of the recording medium or intermediate transfer body. In this case, a mode may be adopted in which a plurality of relatively short recording head modules having nozzle rows which do not reach a length corresponding to the full width of the recording medium or intermediate transfer body are combined and joined together, thereby forming nozzle rows of a length that correspond to the full width of the recording medium.

A full line type head is usually disposed in a direction that is perpendicular to the relative feed direction (relative conveyance direction) of the recording medium, but a mode may also be adopted in which the recording head is disposed following an oblique direction that forms a prescribed angle with respect to the direction perpendicular to the conveyance direction.

A "recording medium" is a medium onto which the liquid ejected from the liquid ejection head is deposited, and is subjected to the recording of an image by the action of the liquid ejection head. More specifically, the "recording medium" indicates a print medium, image forming medium, image receiving medium, ejection receiving medium, or the like. This term includes various types of media, irrespective of material and size, such as continuous paper, cut paper, sealed paper, resin sheets, such as OHP sheets, film, cloth, a printed circuit board on which a wiring pattern, or the like, is formed, and the like.

The "conveyance device" may include a mode where the recording medium or intermediate transfer body is conveyed with respect to a stationary (fixed) liquid ejection head, or a mode where a liquid ejection head is moved with respect to a stationary recording medium or intermediate transfer body, or a mode where both the liquid ejection head and the recording medium or intermediate transfer body are moved.

When forming color images by means of an inkjet head, it is possible to provide heads for each color of a plurality of colored inks (recording liquids) and each liquid of type, or it is possible to eject inks of a plurality of colors, and treatment liquid, from one head.

Furthermore, the present invention may be not limited to a full line head, and may also be applied to a shuttle scanning type recording head (a recording head which ejects droplets while moving reciprocally in a direction substantially perpendicular to the conveyance direction of the recording medium or intermediate transfer body).

In order to attain the aforementioned object, the present invention is also directed to a method of determining an ejection state of a treatment liquid ejection head in an image forming apparatus which forms an image on one of a recording medium and an intermediate transfer body by depositing treatment liquid ejected from the treatment liquid ejection head through nozzles and ink containing coloring material, the treatment liquid being a colorless transparent liquid containing infrared-absorbing material and having at least one of an action of insolubilizing the coloring material, an action of aggregating the coloring material, and an action of preventing dispersion of the coloring material, the method comprising the steps of: irradiating infrared light onto the treatment liquid having been ejected from the treatment liquid ejection head; receiving reflection of the infrared light by a photoelectric transducer having sensitivity to the infrared light; and judging a number and positions of defective ones of the nozzles of the treatment liquid ejection head according to a determination signal obtained from the photoelectric transducer.

According to the present invention, by including an infrared-absorbing material in the treatment liquid, it becomes possible to determine the ejection state of a colorless transparent treatment liquid. Furthermore, since the thermal absorptivity is increased by the presence of the infrared-absorbing material, then the energy required for drying can be reduced in comparison with the related art.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
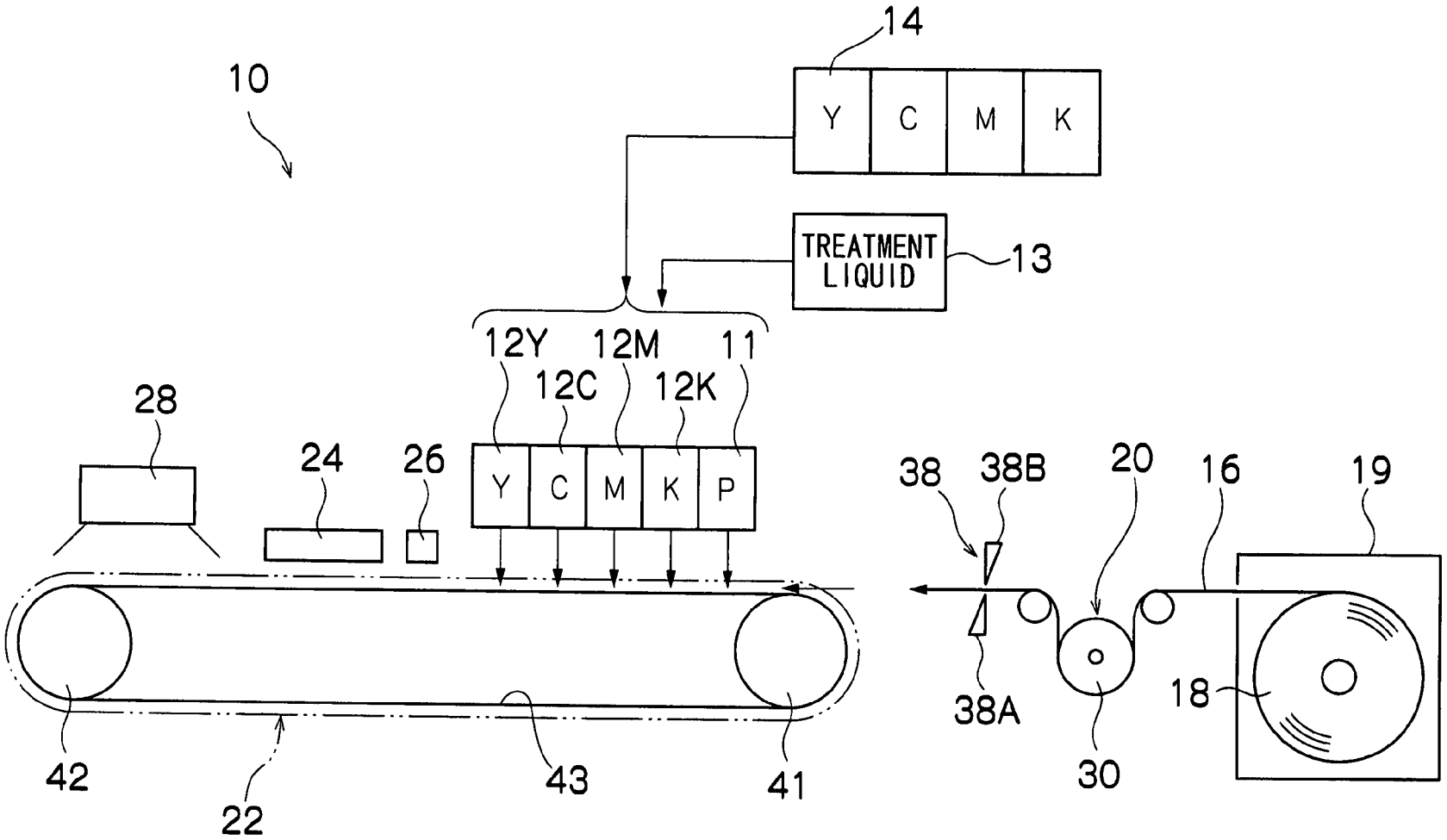
FIG. 1 is a general schematic drawing of an inkjet recording apparatus showing an embodiment of an image forming apparatus according to the present invention.

FIG. 1 is a general schematic drawing of an inkjet recording apparatus which forms an embodiment of an image forming apparatus according to the present invention. As shown in FIG. 1, the inkjet recording apparatus 10 is a two-liquid type of image forming apparatus which forms images by means of a treatment liquid and ink, and it comprises: a treatment liquid head 11 for ejecting treatment liquid constituting a first liquid (pre-treatment liquid) (corresponding to a "treatment liquid ejection device"); a plurality of ink ejection heads (corresponding to an "ink ejection device", hereinafter, called "ink head") 12K, 12M, 12C and 12Y, provided corresponding to the inks (a second liquid) of respective colors of black (K), magenta (M), cyan (C) and yellow (Y); a treatment liquid storing and loading unit 13 which stores treatment liquid to be supplied to the treatment liquid head 11; an ink storing and loading unit 14 which stores colored inks to be supplied to the ink heads 12K, 12M, 12C and 12Y; a medium supply unit 18 which supplies recording medium 16; a decurling unit 20 which removes curl from the recording medium 16; a belt conveyance unit 22 which conveys the recording medium 16 while keeping the recording medium 16 flat; a print determination unit 24 which reads in a printing result; a determination light source 26 (corresponding to an "infrared irradiation device") which illuminates a print determination region on the recording medium 16; and a heating and drying unit 28 which functions as a drying promotion device after printing.

The treatment liquid storing and loading unit 13 has a treatment liquid tank for storing treatment liquid, and the treatment liquid tank is connected to the treatment liquid head 11 through a prescribed channel. The treatment liquid storing and loading unit 13 has a warning device (for example, a display device or an alarm sound generator) for warning when the remaining amount of the treatment liquid is low, and has a mechanism for preventing loading errors between types of liquid.

The ink storing and loading unit 14 has ink tanks for storing the inks of K, C, M and Y to be supplied to the ink heads 12K, 12M, 12C, and 12Y, and the tanks are connected to the heads 12K, 12M, 12C, and 12Y through prescribed channels. The ink storing and loading unit 14 has a warning device (for example, a display device or an alarm sound generator) for warning when the remaining amount of any ink is low, and has a mechanism for preventing loading errors among the colors.

The details of embodiments of the composition of the treatment liquid and the ink used in the present embodiment are described later, and the treatment liquid according to the present embodiment is a colorless transparent liquid that contains an infrared-absorbing agent. When the ink and the treatment liquid mix together, the coloring material in the ink becomes insolubilized or aggregates due to a reaction between the two liquids, or alternatively, the expansion of the coloring material is suppressed by means of a coloring material expansion inhibitor contained in the treatment liquid. Here, "becoming insolubilized or aggregating" includes: a phenomenon where the coloring material separates and precipitates from the solution; a phenomenon where the liquid in which the coloring material is dissolved changes to a solid phase (solidifies); a phenomenon where the dispersion of the coloring material becomes instable, from a dispersed state, and the coloring material aggregates; a phenomenon where the liquid increases in viscosity and cures, and the like.

The reaction speed and the properties of the respective liquids (surface tension, viscosity, or the like) can be adjusted by regulating the respective compositions of the ink and treatment liquids, the concentration of the materials contributing to the reaction, or the like, and desired ink insolubility and/or ink fixing properties (hardening speed, fixing speed, or the like) can be achieved.

In FIG. 1, a magazine 19 for rolled paper (continuous paper) is shown as an embodiment of the medium supply unit 18; however, more magazines with paper differences such as paper width and quality may be jointly provided. Moreover, papers may be supplied with cassettes that contain cut papers loaded in layers and that are used jointly or in lieu of the magazine for rolled paper.

The recording medium 16 delivered from the medium supply unit 18 retains curl due to having been loaded in the magazine 19. In order to remove the curl, heat is applied to the recording medium 16 in the decurling unit 20 by a heating drum 30 in the direction opposite from the curl direction in the magazine 19. The heating temperature at this time is preferably controlled so that the recording medium 16 has a curl in which the surface on which the print is to be made is slightly round outward.

In the case of the configuration in which roll paper is used, a cutter 38 is provided as shown in FIG. 1, and the continuous paper is cut into a desired size by the cutter 38. The cutter 38 has a stationary blade 38A, whose length is not less than the width of the conveyor pathway of the recording medium 16, and a round blade 38B, which moves along the stationary blade 38A. The stationary blade 38A is disposed on the reverse side of the printed surface of the recording medium 16, and the round blade 38B is disposed on the printed surface side across the conveyor pathway. When cut papers are used, the cutter 38 is not required.

After decurling in the decurling unit 24, the cut recording medium 16 is delivered to the belt conveyance unit 22. The belt conveyance unit 22 has a configuration in which an endless belt 43 is set around rollers 41 and 42 in such a manner that at least the portion of the endless belt 43 facing the nozzle faces of the heads 11, 12K, 12M, 12C and 12Y and the sensor face of the print determination unit 24 forms a horizontal plane (flat plane).

The belt 43 has a width that is greater than the width of the recording medium 16, and a plurality of suction apertures (not shown) are formed on the belt surface. A suction chamber (not shown) is provided on the inner side of the belt 43 set about the rollers 41 and 42, and the recording medium 16 is suctioned and held on the belt 43 by creating a negative pressure by suctioning the suction chamber with a fan. It is also possible to use an electrostatic attraction method, instead of a suction-based attraction method.

The belt 43 is driven in the counterclockwise direction in FIG. 1 by the motive force of a motor 138 (not shown in FIG. 1, but shown in FIG. 9) being transmitted to at least one of the rollers 41 and 42, which the belt 43 is set around, and the recording medium 16 held on the belt 43 is conveyed from right to left in FIG. 1.

The inkjet recording apparatus 10 can comprise a roller nip conveyance mechanism, instead of the belt conveyance unit. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

Figure 2A:
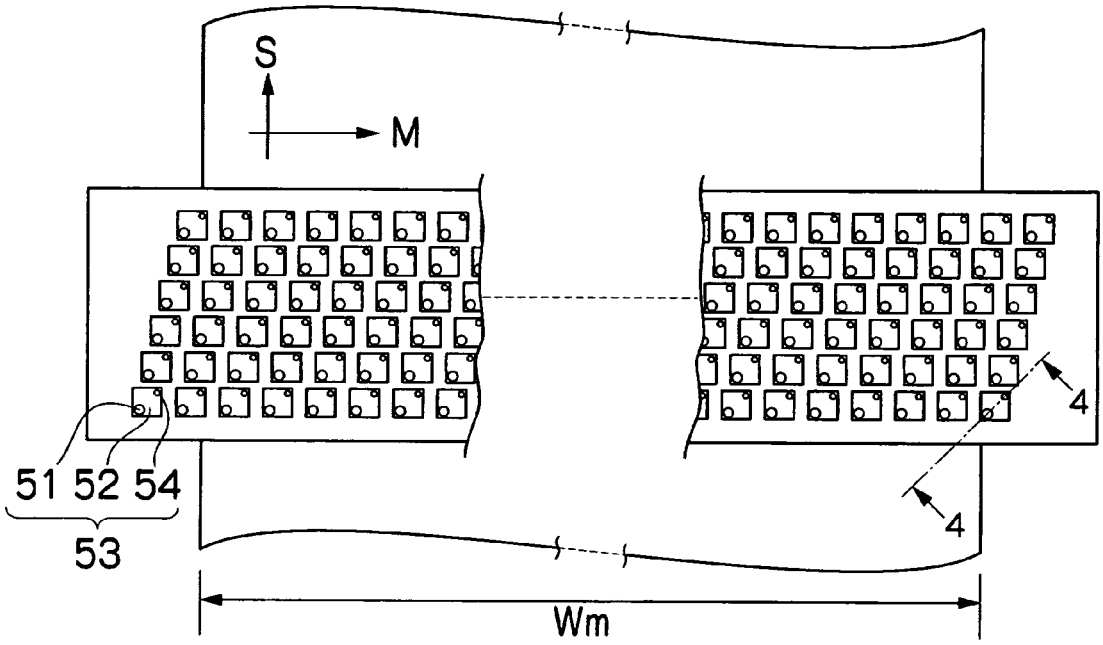
FIGS. 2A and 2B are plan view perspective diagrams showing an embodiment of the composition of an ink head.

The treatment liquid head 11 and the ink heads 12K, 12M, 12C and 12Y are full line heads having a length corresponding to the maximum width of the recording medium 16 used with the inkjet recording apparatus 10, and comprising a plurality of nozzles (ejection ports) arranged on a nozzle face through a length exceeding at least one edge of the maximum-size recording medium 16 (namely, the full width Wm of the printable range) (see FIG. 2A).

As shown in FIG. 1, the ink heads 12K, 12M, 12C and 12Y are arranged in the sequence of the colors, black (K), magenta (M), cyan (C) and yellow (Y), from the upstream side, in the direction of conveyance of the recording medium 16, and the treatment liquid head 11 is disposed further to the upstream side of the ink head 12K. The print heads 11, 12K, 12M, 12C and 12Y are disposed in fixed positions in such a manner that they extend in a direction substantially perpendicular to the conveyance direction of the recording medium 16.

By means of this head arrangement, before droplets of colored inks are deposited by the ink heads 12K, 12M, 12C and 12Y, treatment liquid can be deposited on the recording surface (printing surface) of the recording medium 16 by the treatment liquid head 11. Furthermore, a color image can be formed on the recording medium 16 by depositing inks of different colors from the ink heads 12K, 12M, 12C and 12Y, respectively, onto the recording medium 16 to which the treatment liquid has been applied, while conveying the recording medium 16 at a uniform speed by means of the belt conveyance unit 22.

By adopting a configuration in which full line heads 12K, 12M, 12C and 12Y having nozzle rows covering the full paper width are provided for each separate color in this way, it is possible to record an image on the full surface of the recording medium 16 by performing just one operation of moving the recording medium 16 relatively with respect to the heads 12K, 12M, 12C and 12Y in the paper conveyance direction (the sub-scanning direction) (in other words, by means of one sub-scanning action). A single-pass inkjet recording apparatus 10 of this kind is able to print at high speed in comparison with a shuttle scanning system in which an image is printed by moving a recording head back and forth reciprocally in the main scanning direction, and hence print productivity can be improved.

Although the configuration with the CMYK four standard colors is described in the present embodiment, combinations of the ink colors and the number of colors are not limited to those. Light inks, dark inks, special color inks, or the like can be added as required. For example, a configuration is possible in which heads for ejecting light-colored inks such as light cyan and light magenta are added. Furthermore, there are no particular restrictions of the sequence in which the heads of respective colors are arranged.

The determination light source 26 disposed at a downstream stage of the ink head 12Y of the last color has a length corresponding to the maximum width of the recording medium 16, similarly to the heads 11, 12K, 12M, 12C and 12Y, and it is fixed extending in a direction substantially perpendicular to the conveyance direction of the recording medium 16. For the determination light source 26, a light source emitting light of wavelengths in both the visible region and the infrared region (for example, a halogen lamp) is used. A mode is also possible in which the determination light source is constituted by combining a plurality of light sources emitting light of different wavelengths, for instance, by combining an infrared LED (light-emitting diode) and a visible LED.

The print determination unit 24 has an image sensor for capturing an image of the droplet ejection results of the treatment liquid head 11 and ink heads 12K, 12M, 12C and 12Y, and functions as a device to check for ejection defects, such as blockage of the nozzles, on the basis of the printed image read in by the image sensor.

The print determination unit 24 of the present embodiment is constituted by at least a line sensor having rows of photoelectric transducers of a width that is greater than the liquid droplet ejection width (the image recording width in the main scanning direction) of the heads 11, 12K, 12M, 12C and 12Y. This line sensor is constituted by CCD sensors including a red (R) sensor row composed of photoelectric transducers (pixels) arranged in a line provided with an R filter, a green (G) sensor row provided with a G filter, a blue (B) sensor row provided with a B filter, and a sensor row composed of photoelectric transducers (pixels) that have sensitivity in the infrared (Ir) region, arranged in lines. Instead of a line sensor, it is possible to use an area sensor composed of photoelectric transducers which are arranged two-dimensionally. Furthermore, the imaging elements are not limited to being CCD elements, and it is also possible to use imaging elements based on another system, such as CMOS elements.

The print determination unit 24 reads in a test pattern or actual image of treatment liquid droplets deposited by the treatment liquid head 11, and a test pattern or actual image printed by means of the color ink heads 12K, 12M, 12C and 12Y, and it determines the ejection from the respective heads. The ejection determination includes the presence of ejection, measurement of the dot size, measurement of the dot deposition position, and the like.

The heating and drying unit 28 is a device which promotes drying of the recording medium 16 by irradiating infrared light. As a concrete embodiment of this unit, it is possible to use a halogen lamp, a ceramic heater, a carbon dioxide gas laser, an electrical resistance body made of tungsten, or the like. This heating and drying unit 28 has a length corresponding to the maximum paper width of the recording medium 16, and it is disposed so as to extend in a direction substantially perpendicular to the conveyance direction of the recording medium 16. Also possible is a mode in which the determination light source 26 also serves as the infrared light source for the heating and drying unit 28.

The recording medium 16 which has passed by the heating and drying unit 28 (the generated printed object) is outputted from the paper output unit, through a toothed idle roller and a nip roller (not shown), or the like. Although not shown in FIG. 1, the paper output unit is provided with a sorter for collecting images according to print orders.

Structure of the Head

Next, the structure of the ink heads 12K, 12M, 12C and 12Y is described. Since the heads provided for the respective ink colors each have a common structure, below, a representative ink head is denoted with the reference numeral 50.

Figure 2B:
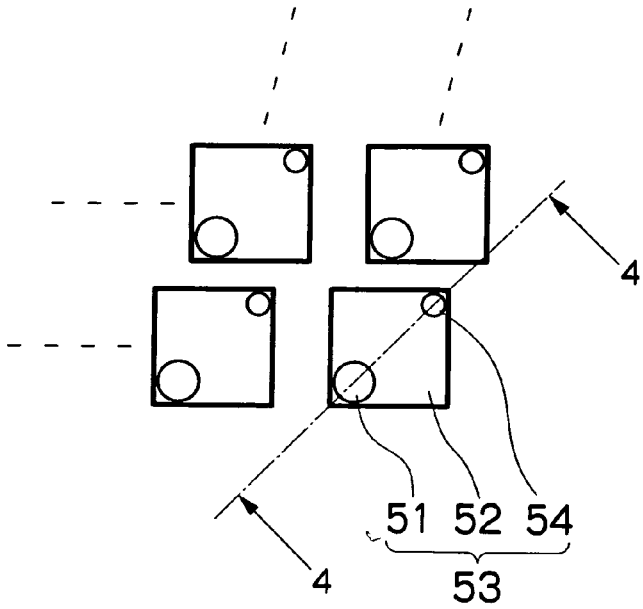

FIG. 2A is a plan view perspective diagram showing an embodiment of the composition of an ink head 50, and FIG. 2B is an enlarged diagram of a portion of same. In order to achieve a high resolution of the dots printed onto the surface of the recording medium 16, it is necessary to achieve a high density of the nozzles in the ink head 50. As shown in FIGS. 2A and 2B, the ink head 50 according to the present embodiment has a structure in which a plurality of ink chamber units are disposed two-dimensionally in the form of a staggered matrix. Each of the ink chamber units has a nozzle 51 forming an ink droplet ejection port, a pressure chamber 52 corresponding to the nozzle 51, and the like, (liquid droplet ejection elements forming recording element units respectively corresponding to nozzles) 53, each, and hence the effective nozzle interval (the projected nozzle pitch) as projected in the lengthwise direction of the head (the direction perpendicular to the paper conveyance direction) is reduced, and high nozzle density is achieved.

Figure 3:
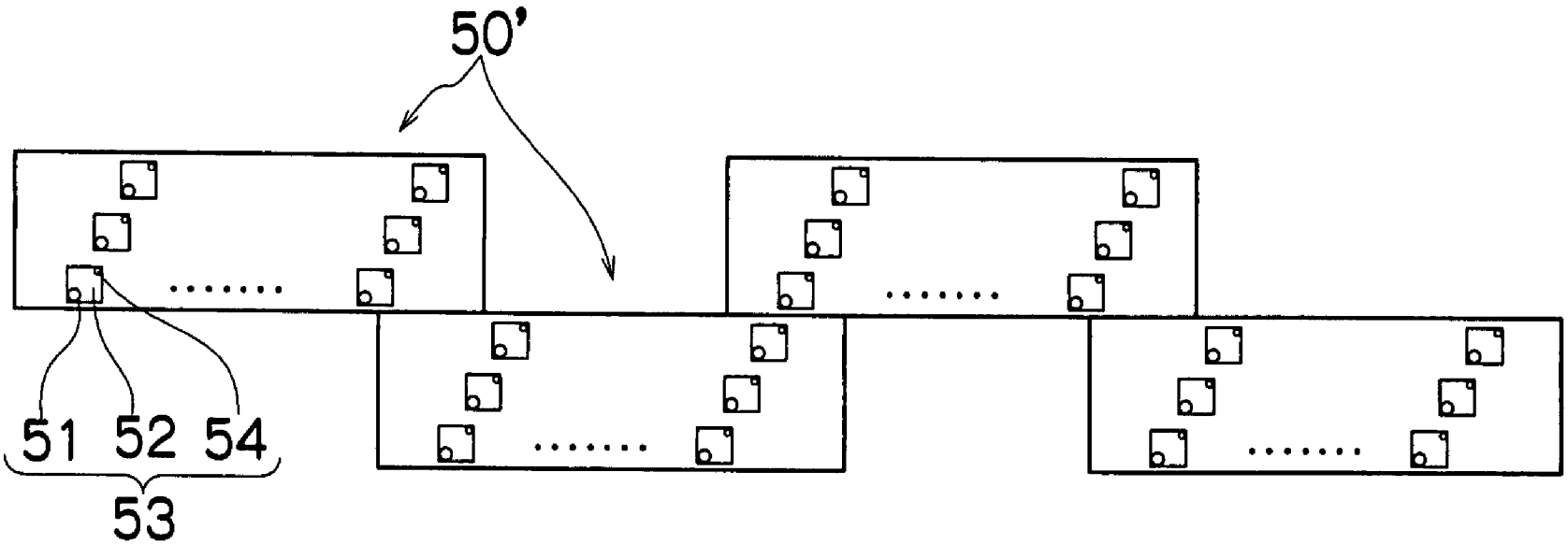
FIG. 3 is a plan view perspective diagram showing a further embodiment of the composition of a full line head.

The invention is not limited to the present embodiment of a mode for constituting nozzle rows which are not less than a length corresponding to the full width Wm of the recording medium 16 in a direction (indicated by arrow M; main scanning direction) which is substantially perpendicular to the feed direction of the recording medium 16 (indicated by arrow S; sub-scanning direction). For example, instead of the composition in FIG. 2A, as shown in FIG. 3, a line head having nozzle rows of a length corresponding to the entire length of the recording medium 16 can be formed by arranging and combining, in a staggered matrix, short head units 50' having a plurality of nozzles 51 arrayed in a two-dimensional fashion.

As shown in FIGS. 2A and 2B, the planar shape of the pressure chamber 52 provided to correspond to each nozzle 51 is substantially a square shape, and the nozzle 51 and an inlet for supplying ink (supply port) 54 are disposed in respective corners on a diagonal line of the square shape. The shape of the pressure chamber 52 is not limited to that of the present embodiment and various modes are possible in which the planar shape is another quadrilateral shape (rhombic shape, rectangular shape, or the like), a pentagonal shape, a hexagonal shape, or other polygonal shape, or a circular shape, elliptical shape, or the like.

Figure 4:
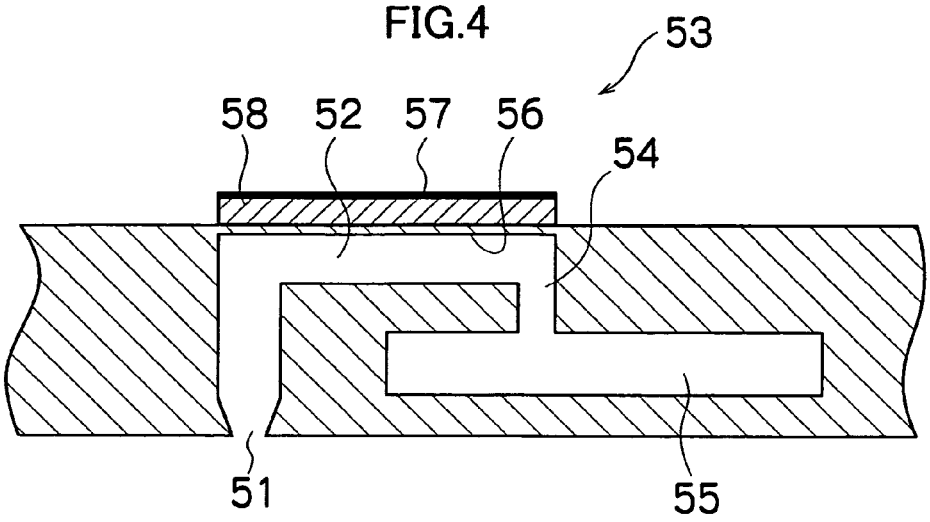
FIG. 4 is a cross-sectional diagram showing the three-dimensional composition of a liquid droplet ejection element of one channel (an ink chamber unit corresponding to one nozzle)

FIG. 4 is a cross-sectional diagram (along line 4-4 in FIG. 2A) showing the three-dimensional composition of the liquid droplet ejection element of one channel (an ink chamber unit corresponding to one nozzle 51). As shown in FIG. 4, each pressure chamber 52 is connected to a common flow passage 55 via the supply port 54. The common flow channel 55 is connected to an ink tank 60 (not shown in FIG. 4, but shown in FIG. 6), which is a base tank that supplies ink, and the ink supplied from the ink tank 60 is delivered through the common flow channel 55 in FIG. 4 to the pressure chambers 52.

An actuator 58 provided with an individual electrode 57 is bonded to a pressure plate (a diaphragm that also serves as a common electrode) 56 which forms the surface of one portion (in FIG. 4, the ceiling) of the pressure chambers 52. When a drive voltage is applied to the individual electrode 57 and the common electrode, the actuator 58 deforms, thereby changing the volume of the pressure chamber 52. This causes a pressure change which results in ink being ejected from the nozzle 51. For the actuator 58, it is possible to adopt a piezoelectric element using a piezoelectric body, such as lead zirconate titanate, barium titanate, or the like. When the displacement of the actuator 58 returns to its original position after ejecting ink, the pressure chamber 52 is replenished with new ink from the common flow channel 55, via the supply port 54.

Figure 5:
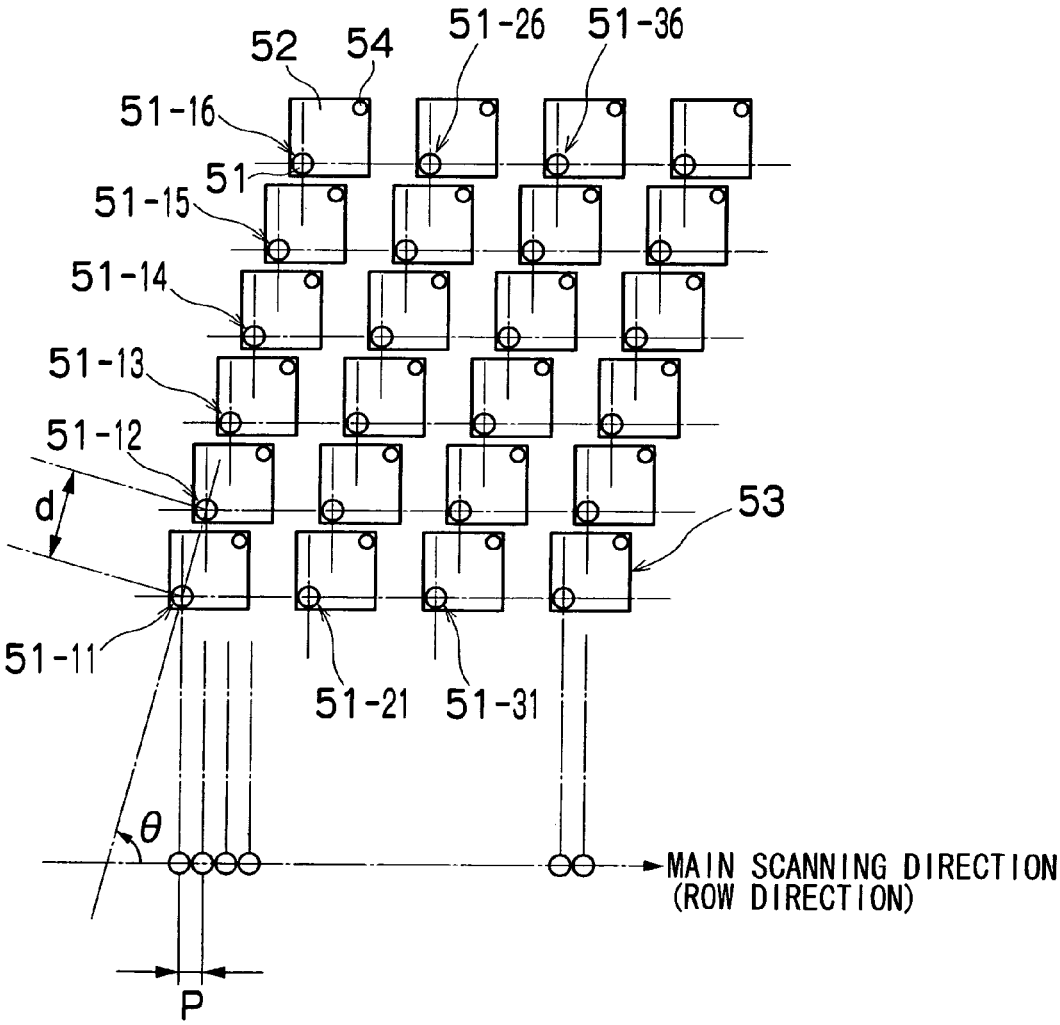
FIG. 5 is an enlarged view showing a nozzle arrangement in the ink head illustrated in FIGS. 2A and 2B.

As shown in FIG. 5, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is d×cos θ, and hence the nozzles 51 can be regarded to be equivalent to those arranged linearly at a fixed pitch P along the main scanning direction. Such configuration results in nozzle rows having a high nozzle density.

In a full-line head comprising rows of nozzles that have a length corresponding to the entire width of the image recordable width, the "main scanning" is defined as printing one line (a line formed of a row of dots, or a line formed of a plurality of rows of dots) in the width direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, . . . , 51-26 are treated as another block; the nozzles 51-31, . . . , 51-36 are treated as another block; . . . ); and one line is printed in the width direction of the recording medium 16 by sequentially driving the nozzles 51-11, 51-12, . . . , 51-16 in accordance with the conveyance velocity of the recording medium 16.

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other.

The direction indicated by one line (or the lengthwise direction of a band-shaped region) recorded by main scanning as described above is called the "main scanning direction", and the direction in which sub-scanning is performed, is called the "sub-scanning direction". In other words, in the present embodiment, the conveyance direction of the recording medium 16 is called the sub-scanning direction and the direction perpendicular to same is called the main scanning direction.

In implementing the present invention, the arrangement of the nozzles is not limited to that of the embodiment illustrated. Moreover, a method is adopted in the present embodiment where an ink droplet is ejected by means of the deformation of the actuator 58, which is typically a piezoelectric element; however, in implementing the present invention, the method used for discharging ink is not limited in particular, and instead of the piezo jet method, it is also possible to apply various types of methods, such as a thermal jet method where the ink is heated and bubbles are caused to form therein by means of a heat generating body such as a heater, ink droplets being ejected by means of the pressure applied by these bubbles.

Although not illustrated here, the structure of the treatment liquid head 11 is approximately the same as the ink head 50 described above. Since the treatment liquid should be deposited on the recording medium 16 in a substantially uniform (even) fashion in the region where ink droplets are to be deposited, it is not necessary to form treatment liquid dots to a high resolution, in comparison with the ink. Consequently, the treatment liquid head 11 may also be composed with a reduced number of nozzles (a reduced nozzle density) in comparison with the ink head 50 for ejecting ink. Furthermore, a composition may also be adopted in which the nozzle diameter of the treatment liquid head 11 is greater than the nozzle diameter of the ink head 50 for ejecting ink.

Configuration of Ink Supply System

Figure 6:
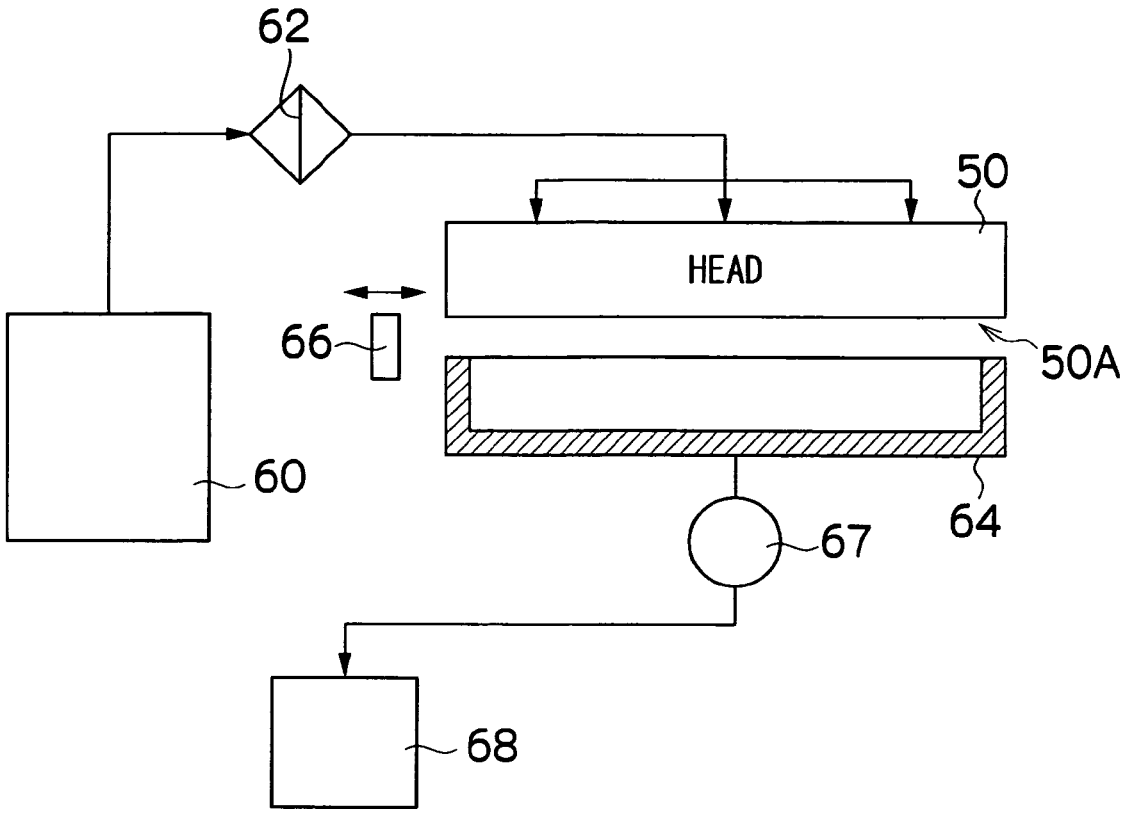
FIG. 6 is a schematic drawing showing the composition of an ink supply system in the inkjet recording apparatus according to the present embodiment.

FIG. 6 is a schematic drawing showing the configuration of the ink supply system in the inkjet recording apparatus 10. The ink tank 60 is a base tank that supplies ink to the ink head 50 and is set in the ink storing and loading unit 14 described with reference to FIG. 1. The ink tank 60 in FIG. 6 is equivalent to the ink storing and loading unit 14 in FIG. 1 described above. The aspects of the ink tank 60 include a refillable type and a cartridge type: when the remaining amount of ink is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type.

A filter 62 for removing foreign matters and bubbles is disposed between the ink tank 60 and the ink head 50 as shown in FIG. 6. The filter mesh size in the filter 62 is preferably equivalent to or less than the diameter of the nozzle. Although not shown in FIG. 6, it is preferable to provide a sub-tank integrally to the ink head 50 or nearby the ink head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face 50A. A maintenance unit (restoration device) including the cap 64 and the cleaning blade 66 can be relatively moved with respect to the ink head 50 by a movement mechanism (not shown), and is moved from a predetermined holding position to a maintenance position below the ink head 50 as required.

The cap 64 is displaced up and down relatively with respect to the ink head 50 by an elevator mechanism (not shown). When the power of the inkjet recording apparatus 10 is turned OFF or when in a print standby state, the cap 64 is raised to a predetermined elevated position so as to come into close contact with the ink head 50, and the nozzle face 50A is thereby covered with the cap 64.

The cleaning blade 66 is composed of rubber or another elastic member, and can slide on the nozzle surface 50A (nozzle plate surface) of the ink head 50 by means of a blade movement mechanism (not shown). If there are ink droplets or foreign matter adhering to the nozzle plate surface, then the nozzle plate surface is wiped clean by causing the cleaning blade 66 to slide over the nozzle plate.

During printing or standby, when the frequency of use of specific nozzles is reduced and ink viscosity increases in the vicinity of the nozzles, a preliminary discharge is made to eject the degraded ink toward the cap 64 (also used as an ink receptacle).

When a state in which ink is not ejected from the ink head 50 continues for a certain amount of time or longer, the ink solvent in the vicinity of the nozzles 51 evaporates and ink viscosity increases. In such a state, ink can no longer be ejected from the nozzle 51 even if the actuator 58 for the ejection driving is operated. Before reaching such a state (in a viscosity range that allows ejection by the operation of the actuator 58) the actuator 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face 50A, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

On the other hand, if air bubbles become intermixed into the nozzle 51 or pressure chamber 52, or if the rise in the viscosity of the ink inside the nozzle 51 exceeds a certain level, then it may not be possible to eject ink in the preliminary ejection operation described above. In cases of this kind, a cap 64 forming a suction device is pressed against the nozzle surface 50A of the ink head 50, and the ink inside the pressure chambers 52 (namely, the ink containing air bubbles of the ink of increased viscosity) is suctioned by a suction pump 67. The ink suctioned and removed by means of this suction operation is sent to a recovery tank 68. The ink collected in the recovery tank 68 may be used, or if reuse is not possible, it may be discarded.

Since the suctioning operation is performed with respect to all of the ink in the pressure chambers 52, it consumes a large amount of ink, and therefore, desirably, preliminary ejection is carried out while the increase in the viscosity of the ink is still minor. The suction operation is also carried out when ink is loaded into the ink head 50 for the first time, and when the head starts to be used after being idle for a long period of time.

The supply system for the treatment liquid and the cleaning (restoration device) for the treatment liquid head 11T are not illustrated, but they have substantially the same composition as the ink supply system and the cleaning (maintenance) device of the ink head shown in FIG. 6.

Description of Ink Set

Next, an ink set (treatment liquid and ink) used in the inkjet recording apparatus 10 according to the present embodiment is described.

As for the treatment liquid and the ink used in the present embodiment, the treatment liquid contains water serving as a solvent, a surface active agent, an aqueous solvent, a cationic polymer, and an infrared-absorbing material; and the ink contains water serving as a solvent, a coloring material (dye), a surface active agent, and an aqueous solvent. Furthermore, it is also possible to include an anionic polymer in the ink. In general, the coloring material is negatively charged (i.e., produces anions including negative ions) in the solvent (water), and therefore, the dye itself has reactive properties that cause itself to react with the cationic polymer in the treatment liquid. In the case of this ink set, the ink coloring material becomes insolubilized due to the reaction between the cationic polymer of the treatment liquid and the coloring material.

Desirably, the infrared-absorbing material contained in the treatment liquid has especially high absorptivity in the light wavelengths in the infrared region. Desirably, the dye or pigment has an absorption peak between the wavelengths of 750 nm to 1200 nm, and as a dye, for example, it is possible to use a commercially available dye or a commonly known dye as described in reference sources (such as the "Manual of Dyes" edited by the Society of Synthetic Organic Chemistry, published 1970). Concrete embodiments of dyes are, for instance: an azo dye, a metal complex azo dye, a pyrazolone azo dye, a naphthoquinone dye, an anthraquinone dye, a phthalocyanine dye, a carbonium dye, a quinone imine dye, a methine dye, a cyanine dye, a squalium dye, or materials such as a beryllium salt, a metal thiolate complex, or the like. The materials which can be used as the infrared-absorbing material are not limited to the examples given here.

As examples of the cationic polymer material included in the treatment liquid, it is possible to use polyarylamine, polyamine sulfone, polyvinylamine, chitosan, or their products formed by the neutralization with an acid.

As examples of the anionic polymer material added to the ink according to requirements, it is possible to use polyacrylic acid, shellac, styrene-acrylate copolymer, styrene-maleic anhydride copolymer, or the like.

Furthermore, as an embodiment of another ink set, the treatment liquid contains water serving as the solvent, a surface active agent, an aqueous solvent, a coloring material aggregating agent, and an infrared-absorbing material; and the ink contains water serving as the solvent, and a coloring material (pigment), a surface active agent, and an aqueous solvent.

For the coloring material aggregating agent, it is possible to use a pH adjuster, or a multivalent metallic salt.

As a material for the pH adjuster, it is possible to use an acid containing an inorganic acid (hydrochloric acid, sulfuric acid, phosphoric acid, or the like) or an organic acid (desirably, an acid containing carboxylic acid, sulfonic acid, or the like, and more specifically, acetic acid, methansulfonic acid, or the like).

As the multivalent metallic salt, it is possible to use various salts of multivalent metallic ions, such as aluminum, calcium, magnesium, iron, zinc, tin, and the like.

In a further embodiment of an ink set, the treatment liquid contains a coloring material dispersion inhibitor, water or oil, or a monomer as a solvent, and an infrared-absorbing agent; and the ink contains a coloring material (pigment or dye), and water or oil or a monomer, as a solvent.

In the present embodiment, the coloring material dispersion inhibitor indicates a material contained in the treatment liquid with the purpose of preventing the dispersion or bleeding of the ink containing coloring material deposited on the treatment liquid.

For the coloring material dispersion inhibitor, at least one agent selected from a group comprising a polymer having an amino group, a polymer having an onium group, a polymer having a nitrogen-containing hetero ring, a metal compound, and a fluorine-based surface active agent, can be used.

By adjusting the compositions of the treatment liquid and the ink, and the densities of the material contributing to the reaction, it is possible to adjust the reaction speed, and the properties of the liquids (surface tension, viscosity, and the like), and hence to achieve desired reactivity and properties.

There are no particular restrictions on the coloring material used in the present embodiment, and provided that it achieves a color hue and color density that matches the object of use of the ink, it is possible to select a coloring material appropriately from commonly known aqueous dyes, oil-based dyes and pigments.

It is possible to use only one type of coloring material and it is also possible to combine two or more types of coloring material. Furthermore, it is possible to use different coloring materials or the same coloring material, for each liquid.

Structural Embodiment of Print Determination Unit

Figure 7A:
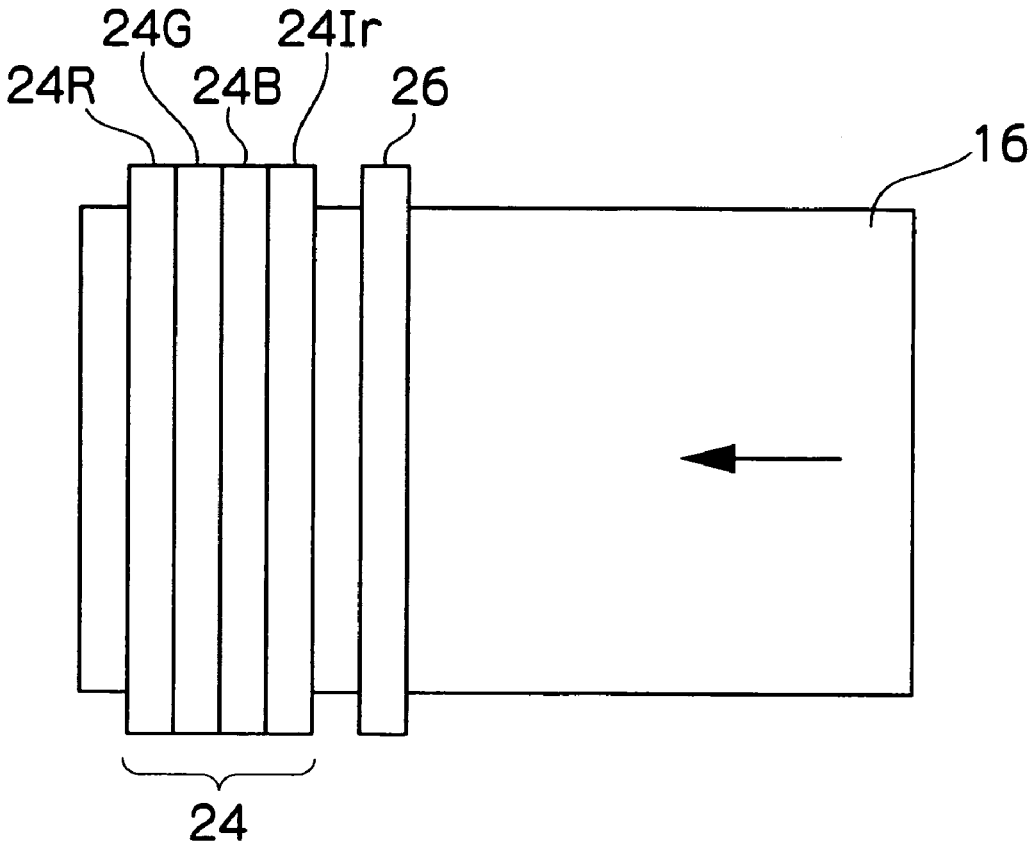
FIGS. 7A and 7B are principal schematic drawings of the peripheral region of a print determination unit.

Next, an embodiment of the detailed composition of a print determination unit 24 shown in FIG. 1 is described. FIG. 7A is a plan diagram of the periphery of the print determination unit 24, and FIG. 7B is a side view of same.

Figure 7B:
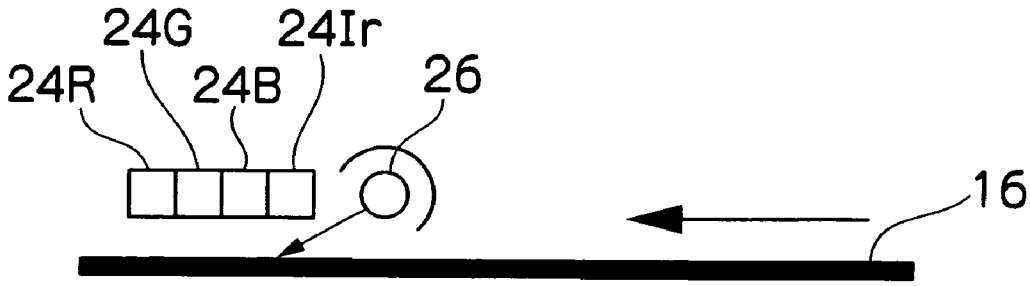

As shown in FIGS. 7A and 7B, the print determination unit 24 comprises an R sensor row 24R, a G sensor row 24G, a B sensor row 24B, and an Ir sensor row 24Ir, having high determination sensitivity in the respective wavelengths of R, G, B, and Ir light. In the case of the present embodiment, the RGB sensor rows 24R, 24G and 24B correspond to an "ink determination device", and the Ir sensor row 24Ir correspond to a "treatment liquid determination device".

Light is irradiated onto the determination region on the recording medium 16 by means of the determination light source 26, which is disposed on the upstream side of the print determination unit 24, and the reflected light from the recording medium 16 is received by the sensor rows 24R, 24G, 24B and 24Ir.

The infrared light contained in the light irradiated from the determination light source 26 is absorbed by the infrared-absorbing material in the treatment liquid, whereby the application pattern of the treatment liquid (the arrangement pattern of the treatment liquid dots) is determined by the Ir sensor row 24Ir.

Furthermore, the application patterns of the colored inks (the arrangement patterns of the ink dots) are determined by the R, G, B sensor rows 24R, 24G and 24B. The positioning sequence of the sensor rows, and the location of the determination light source 26 are not limited to the embodiment shown in FIGS. 7A and 7B. For example, a mode is also possible in which the determination light source 26 is disposed on the downstream side of the print determination unit 24.

Figure 8:
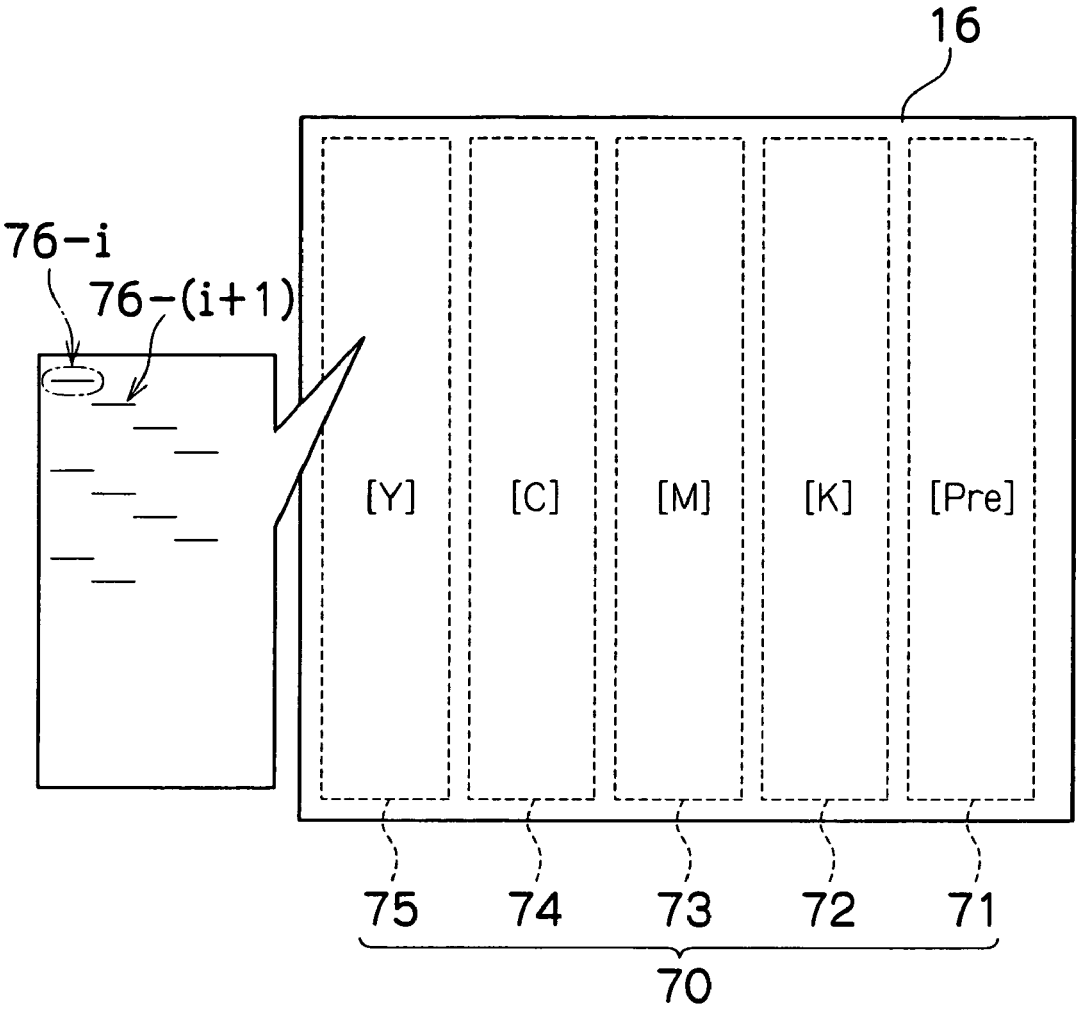
FIG. 8 is a schematic diagram showing a print embodiment of a test pattern (nozzle check pattern) for determining the ejection state.

FIG. 8 is a schematic diagram showing a print example of a test pattern (nozzle check pattern) for determining the ejection state. As shown in FIG. 8, a check pattern 70 is printed by dividing the recording medium 16 for the heads. In FIG. 8, the check pattern 70 is printed in such a manner that similarly to the head arrangement sequence, the following respective regions are aligned in sequence on the recording medium 16, from the right: a treatment liquid (Pre) nozzle check pattern region 71, a black (K) ink nozzle check pattern region 72, a magenta (M) ink nozzle check pattern region 73, a cyan (C) ink nozzle check pattern region 74, and a yellow (Y) ink nozzle check pattern region 75.

The check patterns in the respective regions 71 to 74 are each constituted by lines (called "check pattern lines") 76-*i* having a prescribed number of dots aligned in the sub-scanning direction (the lateral direction in FIG. 8) formed by carrying out consecutive droplet ejection a plurality of times, from one nozzle (the i-th nozzle in the head, for example), as shown in the partial enlarged diagram in FIG. 8. Furthermore, the droplet ejection timing is staggered between the nozzles that deposit droplets onto pixels which are mutually adjacent in the main scanning direction (between the i-th nozzle and (i+1)-th nozzle, for example), in such a manner that the respective check pattern lines 76-*i*, 76-(*i*+1), . . . , are not superimposed, between the nozzles that deposit droplets onto pixels which are mutually adjacent in the main scanning direction (the vertical direction in FIG. 8). By staggering the recording positions of the check pattern lines 76-*i*, 76-(*i*+1), . . . of mutually adjacent nozzles, respectively, in the sub-scanning direction on the recording medium 16, then the check pattern lines 76-*i*, 76-(*i*+1) corresponding to the respective nozzles are separated from each other, thereby facilitating reading by the print determination unit 24. Consequently, it is possible readily to measure the presence or absence of ejection, the dot size and the dot deposition positions, or the like, of the respective nozzles.

If there is a nozzle which is not capable of ejection, then the check pattern line corresponding to this nozzle is not printed, and by discovering the location where a check pattern line is missing (location of omission), it is possible to identify the position of the defective nozzle. Furthermore, it is also possible to identify the number of defective nozzles from the number of omitted check pattern lines.

Moreover, if there is a nozzle suffering an ejection direction (flight direction of the ejected droplet) abnormality, the check pattern line corresponding to the nozzle is printed at a position that is displaced from the originally intended recording position (the ideal droplet deposition position), and hence the presence or absence of an ejection direction abnormality can be ascertained by measuring the amount of divergence of the droplet deposition positions. By reading in the printing state of the test pattern by means of the print determination unit 24 in this way, and analyzing the image signal obtained by the print determination unit 24 (the image signal of the printing result), it is possible to determine the ejection states of the nozzles.

The printing result of the treatment liquid is read out by the Ir sensor row 24Ir, and the printing results of the colored inks are ascertained by the combination of the signals (RGB signals) of the color channels obtained from the RGB sensor rows 24R, 24G and 24B.

In the present embodiment, from the viewpoint of readily determining the printing state of the heads, check patterns are printed respectively onto separate regions for the heads, but it is also possible to use check patterns obtained by depositing droplets of a plurality of different types of liquid onto the same position on the recording medium, in a superimposed fashion.

Description of Control System

Figure 9:
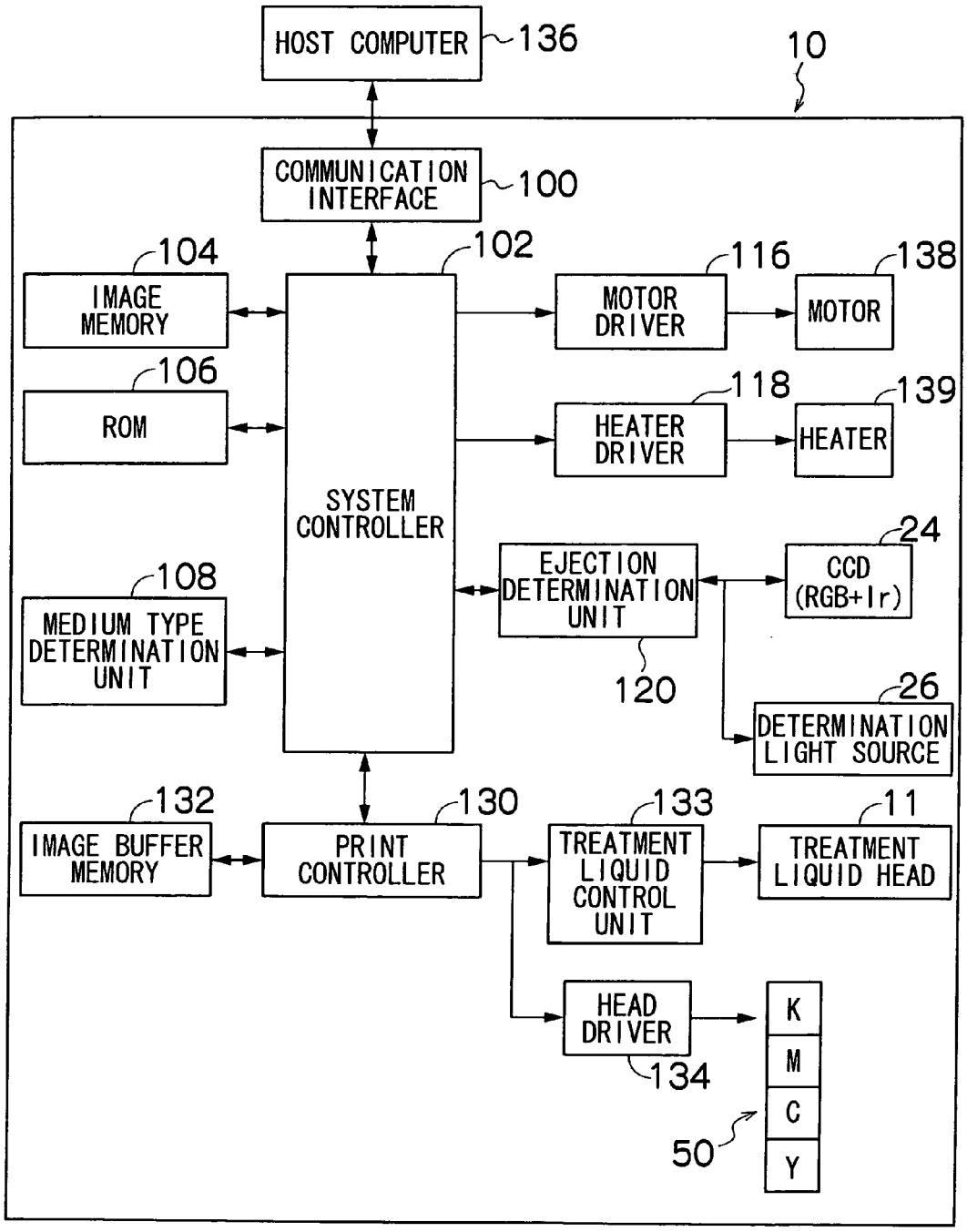
FIG. 9 is a principal block diagram showing the system configuration of the inkjet recording apparatus according to the present embodiment.

FIG. 9 is a principal block diagram showing the system composition of the inkjet recording apparatus 10. The inkjet recording apparatus 10 comprises a communication interface 100, a system controller 102, an image memory 104, a ROM 106, a medium type determination unit 108, a motor driver 116, a heater driver 118, an ejection determination unit 120, a print controller 130, an image buffer memory 132, a treatment liquid control unit 133, a head driver 134, and the like.

The communication interface 100 is an interface unit (image input unit) which functions as an image input device for receiving image data transmitted by a host computer 136. For the communication interface 100, a serial interface, such as USB (Universal Serial Bus), IEEE 1394, an Ethernet (registered tradename), or a wireless network, or the like, or a parallel interface, such as a Centronics interface, or the like, can be used. It is also possible to install a buffer memory (not illustrated) for achieving high-speed communications.

Image data sent from a host computer 136 is read into the inkjet recording apparatus 10 via the communication interface 100, and it is stored temporarily in the image memory 104. The image memory 104 is a storage device for temporarily storing an image input via the communication interface 100, and data is written to and read from the image memory 104 via the system controller 102. The image memory 104 is not limited to a memory having a semiconductor element, and a magnetic medium, such as a hard disk, or the like, may also be used.

The system controller 102 is constituted by a central processing device (CPU) and peripheral circuits thereof, and the like, and it functions as a control device for controlling the whole of the inkjet recording apparatus 10 in accordance with a prescribed program, as well as a calculation device for performing various calculations.

More specifically, the system controller 102 is a control unit which controls the various sections, such as the communication interface 100, image memory 104, motor driver 116, heater driver 118, ejection determination unit 120, printer controller 130, and the like, and as well as controlling communications with the host computer 136 and writing and reading to and from the image memory 104, it also generates control signals for controlling the motor 138 and heater 139 or the like of the conveyance system.

The ROM 106 stores a program to be executed by the CPU of the system controller 102, and various data required for control operations (data for nozzle check patterns, a threshold value table for determining ejection, etc.), and the like. The ROM 106 may be a non-rewriteable storage device, or it may be a rewriteable storage device, such as an EEPROM. The image memory 104 is used as a temporary storage region for the image data, and it is also used as a program development region and a calculation work region for the CPU.

The medium type determination unit 108 is a device (corresponding to a "medium type identification device") which acquires information relating to the medium type, and it is constituted by a device which determines the paper type, wettability, size, and the like, of the recording medium 16 (for example, it is a sensor which determines the optical reflectivity of the paper, a paper width determination sensor, a sensor which determines the thickness of the paper, or a suitable combination of these). The type of recording medium is judged automatically by the medium type determination unit 108, and control is implemented in such a manner that suitable treatment liquid deposition and ink ejection are achieved in accordance with the medium type.

The device which acquires information relating to the medium type is not limited to the composition described above. For example, it is also possible to adopt a composition in which an information recording body, such as a barcode or radio tag, which records medium type information, is attached to the magazine 19 of the medium supply unit 18 shown in FIG. 1, and the type of medium used is identified automatically by reading in the information of this information recording body by means of a prescribed reading apparatus (information reading device). Furthermore, it is also possible to adopt a composition in which recording medium information relating to the paper type, wettability, size, or the like, is specified by means of an input via a prescribed user interface, instead of or in conjunction with such automatic determination devices.

The information obtained by the medium type determination unit 108 shown in FIG. 9 is sent to the system controller 102. The system controller 102 sets judgment threshold values in the ejection determination unit 120, as well as controlling treatment liquid ejection and ink ejection, on the basis of the information obtained from the medium type determination unit 108 and the image data for printing.

The motor driver 116 is a driver (drive circuit) which drives the motor 138 in accordance with instructions from the system controller 102. The heater driver 118 is a driver for driving the heater 139 of the heating drum 30 (see FIG. 1), and other sections, in accordance with instructions from the system controller 102.

The ejection determination unit 120 in FIG. 9 comprises a light source control circuit which controls the on and off switching of the determination light source 26 and the light emission intensity when it is switched on, a drive circuit for driving the CCDs of the print determination unit 24, and a signal processing circuit which processes the signals outputted from the CCDs. The ejection determination unit 120 controls light emission from the determination light source 26 in accordance with instructions from the system controller 102, as well as controlling the reading operation performed by the print determination unit 24 and analyzing the signal obtained from the print determination unit 24.

The print controller 130 functions as a signal processing device which performs corrections and other types of processing in order to generate a signal for controlling ink ejection and a signal for controlling treatment liquid ejection, from the image data in the image memory 104 (multiple-value input image data), in accordance with the control implemented by the system controller 102. Furthermore, the print controller 130 functions as an ink ejection control device which controls the ejection driving of the ink head 50 by supplying the generated ink ejection data to the ink head driver 134, as well as functioning as a treatment liquid deposition control device which controls the ejection driving of the treatment liquid head 11 by generating data for treatment liquid ejection in conjunction with the treatment liquid control unit 133.

The head driver 134 drives the actuators 58 which drive ejection in the respective heads 50, on the basis of the ink ejection data supplied from the print controller 130. A feedback control system for maintaining constant drive conditions for the heads may be included in the head driver 134.

Prescribed signal processing is carried out in the print controller 130, and the treatment liquid ejection volume and ejection timing of the treatment liquid head 11 are controlled by means of the treatment liquid control unit 133, and the ink ejection volume and ejection timing of the ink heads 50 of the respective colors are controlled by means of the head driver 134, on the basis of the image data. Thus, prescribed dot sizes and dot positions can be achieved.

The image buffer memory 132 is provided in the print controller 130, and image data, parameters, and other data are temporarily stored in the image buffer memory 132 when image data is processed in the print controller 130. FIG. 9 shows a mode in which the image buffer memory 132 is attached to the print controller 130; however, the image memory 104 may also serve as the image buffer memory 82. Also possible is a mode in which the print controller 130 and the system controller 102 are integrated to form a single processor.

To give a general description of the sequence of processing from image input to print output, image data to be printed (original image data) is input from an external source via the communication interface 100, and is accumulated in the image memory 104. At this stage, multiple-value RGB input image data is stored in the image memory 104, for example.

In this inkjet recording apparatus 10, an image which appears to have continuous tonal graduations to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 104 is sent to the print controller 130 through the system controller 102, and is converted to the dot data (droplet ejection arrangement data) for each ink color by a halftoning technique, using dithering, error diffusion, or the like.

More specifically, the print controller 130 performs processing for converting the input RGB image data into dot data for the four colors of K, C, M and Y. The dot data generated by the print controller 130 in this way is stored in the image buffer memory 132. This dot data of the respective colors is converted into C, M, Y, K droplet ejection data for ejecting inks from the nozzles of the ink heads 50, thereby establishing the ink ejection data to be printed.

The ink head driver 134 outputs drive signals for driving actuators 58 corresponding to the respective nozzles 51 of the ink heads 50 on the basis of the ink ejection data supplied by the print controller 130.

Similarly, the treatment liquid control unit 133 outputs drive signals for driving the actuators corresponding to the respective nozzles of the treatment liquid head 11, on the basis of treatment liquid ejection data generated from the image data (treatment liquid dot data generated in correlation with the ink deposition volume). More specifically, the treatment liquid control unit 133 encompasses a device forming a treatment liquid head driver.

By supplying the drive signals output by the treatment liquid control unit 133 to the treatment liquid head 11, treatment liquid is ejected from the corresponding nozzles. Furthermore, by supplying the drive signals output by the ink head driver 134 to the ink head 50, ink is ejected from the corresponding nozzles 51. By controlling the ejection of treatment liquid from the treatment liquid head 11 and the ejection of ink from the ink head 50 in synchronism with the conveyance speed of the recording medium 16, an image is formed on the recording medium 16.

As described above, the ejection volume and the ejection timing of the liquid droplets from the treatment liquid head 11 and the ink head 50 are controlled, on the basis of the treatment liquid ejection data and ink ejection data generated by implementing prescribed signal processing in the print controller 130. By this means, prescribed dot sizes and dot positions can be achieved.

In the present embodiment, at the stage prior to the halftoning process, the image data is corrected to take account of defective ejection nozzles, and therefore streak-shaped density non-uniformities caused by defective nozzles can be prevented accurately.

As described with reference to FIGS. 7A and 7B, the print determination unit 24, which is a block including the image sensors, reads in the test pattern or actual image printed on the recording medium 16, performs various signal processing operations, and the like, and determines the print situation (presence/absence of ejection, variation in deposition positions of ejected droplets, optical density, and the like). The determination results thus obtained are supplied to the system controller 102.

The system controller 102 and the print controller 130 implement various corrections with respect to the treatment liquid head 11 and the ink heads 50, according to requirements, on the basis of the information obtained from the print determination unit 24, and they implement control for carrying out cleaning operations (maintenance operations for restoring the nozzle ejection performance), such as preliminary ejection, suctioning, or wiping, as and when necessary.

In the case of the present embodiment, the system controller 102 corresponds to the "first restoration control device", the "second restoration control device" and the "threshold value setting device", and a combination of the system controller 102, the print controller 130 and the treatment liquid control unit 133 corresponds to the "test pattern droplet ejection control device". Furthermore, a combination of the system controller 102 and the print controller 130 corresponds to the "image processing device"; and a combination of the ejection determination unit 120 and the system controller 102 corresponds to the "treatment liquid ejection failure determination device" and the "ink ejection failure determination device".

The various processing functions of the system controller 102, and the like, may be achieved by means of an ASIC (application specific integrated circuit), software, or a suitable combination of these.

Figure 10:
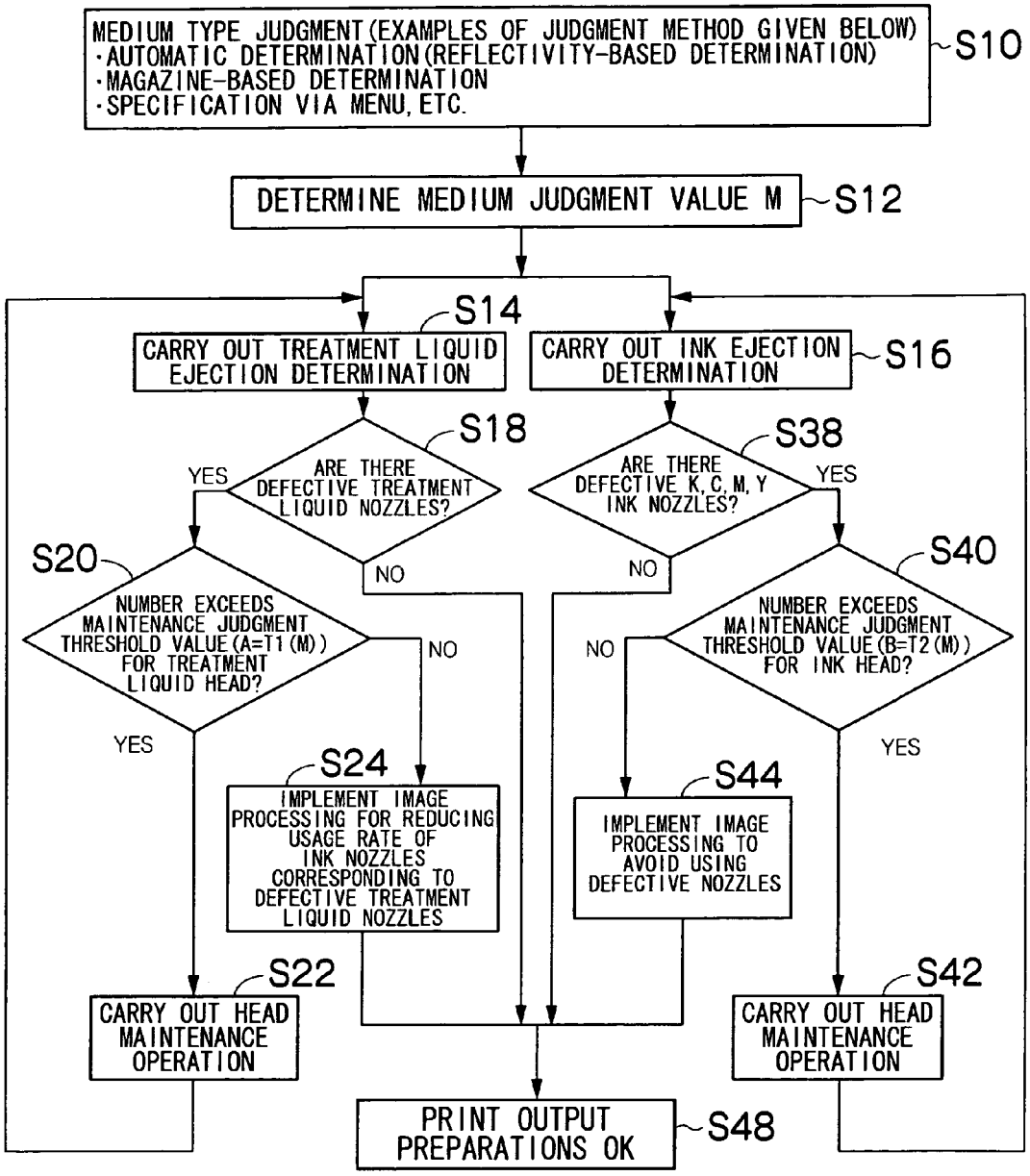
FIG. 10 is a flowchart showing an embodiment of a control procedure in the inkjet recording apparatus according to the present embodiment.

FIG. 10 is a flowchart indicating the control sequence of the inkjet recording apparatus 10 according to the present embodiment. As shown in this diagram, firstly, a medium type judgment process is implemented (step S10). This judgment may be based, for example, on automatic determination by measuring the optical reflectivity of the recording medium 16, or on determination of the paper magazine, or specification of a paper type via a user interface menu, or the like.

On the basis of the medium type judgment result in step S10, the judgment value (M) corresponding to the type of recording medium 16 used is established (step S12). The inkjet recording apparatus 10 comprises an information storage device (internal memory or external memory) which stores data for a medium type table that associates media types with judgment values (M). The judgment value (M) is determined by referring to the medium type table.

The judgment value is changed according to the type of medium because the tolerable level of the defectiveness of the nozzles varies depending on the difference in permeability of the medium, and the like, when the medium type is changed. For example, when printing onto special inkjet paper which has low permeation and bleeding, any striping caused by ejection failure from a nozzle will be readily visible, and therefore the threshold value for the tolerable number of defective nozzles is relatively low. On the other hand, when printing onto normal paper which has high permeation and bleeding, the threshold value of the tolerable number of defective nozzles is relatively high.

Next, ejection determination for the treatment liquid is carried out (step S14), and ejection determination for the ink is carried out (step S16). In the treatment liquid ejection determination step in S14, a check pattern is printed by the treatment liquid head 11, and the corresponding printing result is then read in by the Ir sensor row 24Ir of the print determination unit 24, and the determination signal is processed. Similarly, in the ink ejection determination step in S16, check patterns are printed by the color ink heads 12K, 12M, 12C and 12Y, the corresponding printing results are read in by the R, G, B sensor rows 24R, 24G, 24B of the print determination unit 24, and the determination signal is processed.

To describe the process in the case of the treatment liquid, it is judged from the determination results at step S14 whether or not there is a defective nozzle in the treatment liquid head 11 (step S18). If there is a defective nozzle, then the procedure advances to step S20, where it is judged whether or not the number of defective nozzles has exceeded the judgment threshold value A (=T1(M)) for determining the maintenance of the treatment liquid head. The judgment threshold value A corresponds to the "first threshold value".

The judgment threshold value A is set in accordance with the type of recording medium 16. The inkjet recording apparatus 10 comprises an information storage device (internal memory or external memory) which stores data for a threshold value table T1 that associates media judgment values (M) with judgment threshold values A. The judgment threshold value A=T1(M) to be used is specified by referring to the threshold value table T1.

At step S20, the number of defective nozzles is compared with the judgment threshold value A, and if the number of defective nozzles has exceeded the judgment threshold value A, then it is judged that maintenance of the head is necessary. The procedure then advances to step S22, where a maintenance operation of the treatment liquid head 11 is carried out.

The maintenance operation may include preliminary ejection, nozzle suctioning, wiping of the nozzle surface, or the like. In the present embodiment, the number of defective nozzles is compared with the judgment threshold value A, but instead of the mode that uses the actual value of the number of defective nozzles, it is also possible to adopt a mode that determines an evaluation value derived in accordance with a function that is correlated to the number of defective nozzles, or the like (a maintenance evaluation value which reflects the number of defective nozzles), and then compares this evaluation value with a judgment threshold value.

After carrying out the maintenance operation at step S22, the procedure returns to step S14 and the ejection state of the treatment liquid is determined again.

If it is confirmed that there are no defective nozzles at step S18, then the procedure advances to step S48, and after waiting until the completion of the ink ejection determination routine described below (steps S16 and S38 to S44), the preparations for print output are completed.

If the number of defective nozzles does not exceed the judgment threshold value A at step S20, then the procedure advances to step S24. In this case, the presence of defective nozzles is confirmed, but it is judged that the number of defective nozzles is relatively small and within a tolerable range from the viewpoint of image quality. Therefore, no maintenance operation is implemented. Then, at step S24, image processing is carried out (the ink droplet deposition arrangement is corrected) to specify the ink droplet deposition arrangement in such a manner that the usage rate is reduced for the nozzles of the ink head 50 that correspond to the positions of the defective treatment liquid nozzles. More specifically, in the present embodiment, halftoning is carried out in a sequence which reduces the usage rate of the corresponding nozzle positions, with respect to all of the ink colors, thereby specifying the ink droplet ejection arrangement. After step S24, the procedure advances to step S48.

Next, the processing for the inks is described. On the basis of the determination results at step S16, it is judged whether or not there are defective nozzles in each of the ink heads 50 of the colors of K, C, M and Y (step S38). If there is a defective nozzle, then the procedure advances to step S40, where it is judged, for each color, whether or not the number of defective nozzles has exceeded the judgment threshold value B=T2(M) for determining the maintenance of the ink head. The judgment threshold value B corresponds to the "second threshold value".

The judgment threshold value B is set in accordance with the type of recording medium 16. The inkjet recording apparatus 10 comprises an information storage device (internal memory or external memory) which stores data for a threshold value table T2 that associates media judgment values (M) with judgment threshold values B. The judgment threshold value B=T2(M) to be used is specified by referring to the threshold value table T2.

The judgment threshold value B=T2(M) is set to the value different to the treatment liquid judgment value A=T1(M). In other words, since the colorless transparent treatment liquid itself has low visibility, then an ejection failure of the treatment liquid has a lesser effect on the image quality than the ink, and therefore print productivity is raised by setting the judgment threshold value A, which is used as a reference for judging the implementation of a maintenance operation, to a relatively large value. On the other hand, the colored inks produced marked image deterioration if they suffer an ejection failure, and therefore high-quality output can be prioritized by setting the judgment threshold value B to a relatively small value.

At step S40, the number of defective nozzles is compared with the judgment threshold value B, and if the number of defective nozzles has exceeded the judgment threshold value B, then it is judged that maintenance of the head is necessary. The procedure then advances to step S42, where a maintenance operation of the ink head 50 is carried out.

The maintenance operation may include preliminary ejection, nozzle suctioning, wiping of the nozzle surface, or the like. Here, it is not necessary for the maintenance operation in the treatment liquid head 11 and the maintenance operation in the ink heads 50 to have the same contents. In other words, it is possible to vary the sequence of the maintenance operations between the treatment liquid head 11 and the ink heads 50. Furthermore, it is also possible to set different processing contents in the maintenance operation and different numbers of processing operations, and the like, in accordance with the number of defective nozzles.

After carrying out the maintenance operation at step S42, the procedure returns to step S16 and the ejection state of the inks is determined again.

If it is confirmed that there are no defective nozzles at step S38, then the procedure advances to step S48, and after waiting until the completion of the treatment liquid ejection determination routine described above (steps S14 to S24), the preparations for print output are completed.

If the number of defective nozzles does not exceed the judgment threshold value B at step S40, then the procedure advances to step S44. In this case, the presence of defective nozzles is confirmed, but it is judged that the number of defective nozzles is relatively small and within a tolerable range from the viewpoint of image quality. Therefore, no maintenance operation is implemented. Then, at step S44, image processing is carried out (the ink droplet deposition arrangement is corrected) to specify the droplet deposition arrangement for the inks in such a manner that the defective nozzles are not used and the usage rate of the nozzles peripheral to the defective nozzles is increased. In the present embodiment, halftoning is carried out and the ink droplet deposition arrangement is specified under conditions where the defective nozzles are not used. After step S44, the procedure advances to step S48.

When the preparations for print output have completed at step S48, a print operation corresponding to the input image data is carried out.

Modification 1

In the above-described embodiments, the aqueous treatment liquid and ink are used, but the present invention may also be applied to cases where oil-based treatment liquid and ink are used. The above-described embodiments relate to examples of the mixing of two liquids, namely, a pre-treatment liquid and ink, but the present invention may also be applied to a case where a plurality of types of liquid, such as three or more types of liquid, are mixed together. Furthermore, a mode is also possible in which a plurality of different types of treatment liquid are prepared in advance, and one type of treatment liquid or a suitable combination of two or more types of treatment liquid are selected, according to the type of recording medium used.

Modification 2

The above-described embodiments relate to a composition where a treatment liquid forming a first liquid is deposited onto a recording medium, whereupon droplets of ink forming a second liquid are deposited onto the treatment liquid, but the deposition sequence of the treatment liquid and the ink is not limited to that, and it is also possible to adopt a mode where droplets of ink are deposited first and droplets of treatment liquid are deposited subsequently, or a mode where treatment liquid and ink are deposited simultaneously onto the medium, or the like.

Furthermore, in the above-described embodiments, the liquid ejected from the treatment liquid head 11 or the ink heads 50 is directly deposited on the recording medium 16, but a mode is also possible in which droplets of the treatment liquid and the ink are deposited onto an intermediate transfer body, and the treatment liquid and ink are then applied onto the recording medium by being transferred from the intermediate transfer body.

Modification 3

The inkjet recording apparatus 10 described in FIG. 1 has a composition in which the treatment liquid head 11 is arranged only on the upstream side of the ink head 12K in terms of the conveyance direction of the recording medium (the right-hand side in FIG. 1), but in implementing the present invention, it is also possible to adopt a composition in which treatment liquid heads are disposed respectively on the upstream sides of the ink heads 12K, 12M, 12C and 12Y According to this composition, it is possible to deposit a suitable amount of treatment liquid for each color of ink.

Modification 4

Furthermore, in the above-described embodiments, the inkjet recording apparatus using the page-wide full line type heads having a nozzle row of a length corresponding to the entire width of the recording medium is described, but the scope of application of the present invention is not limited to this, and the present invention may also be applied to an inkjet recording apparatus using a shuttle head which performs image recording while moving a short recording head reciprocally.

Modification 5

The above-described embodiments relate to the inkjet recording apparatus of a type which forms images by ejecting ink droplets directly toward a recording medium, such as recording paper (a direct recording method), but the scope of application of the present invention is not limited to this.

Figure 11:
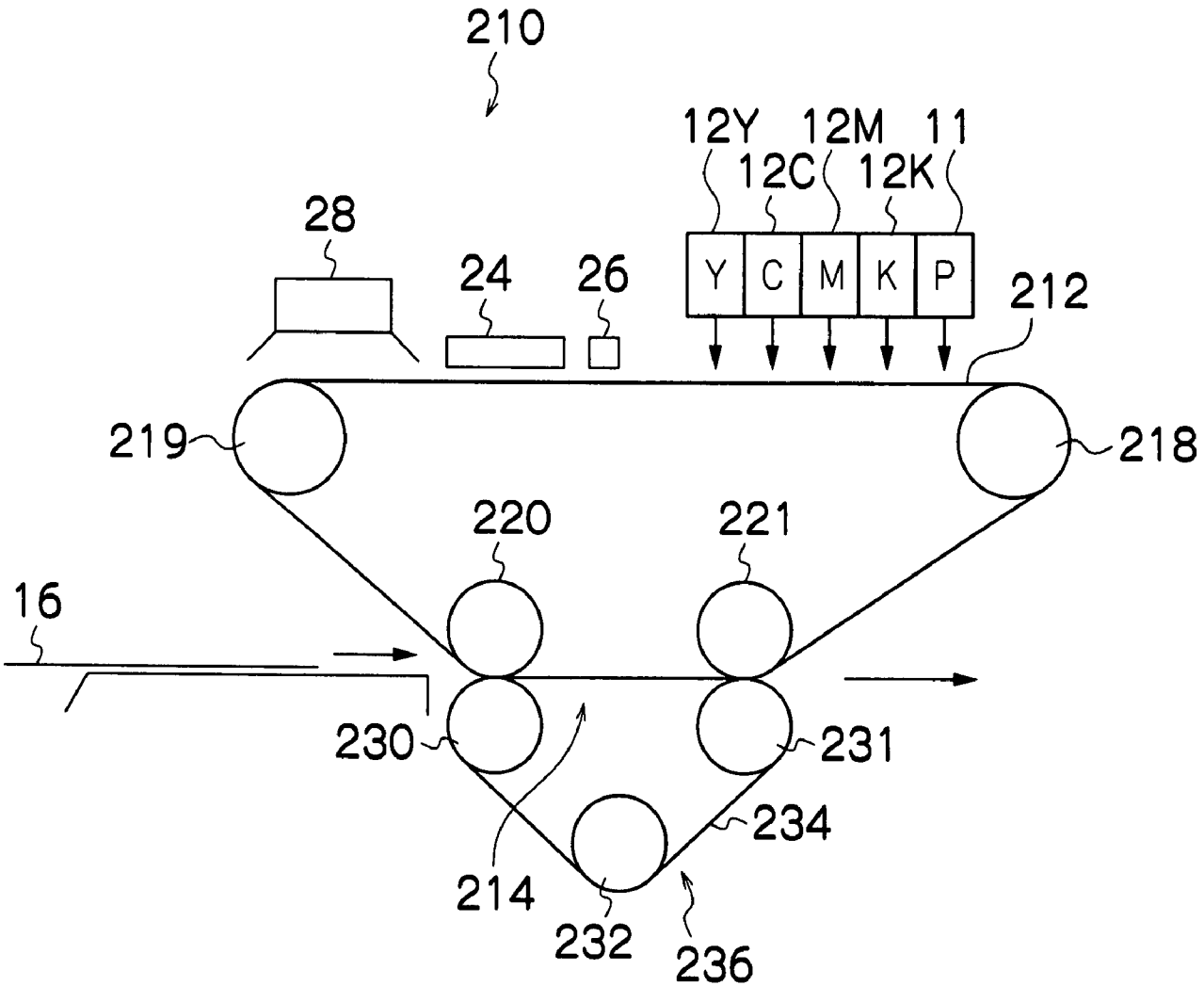
FIG. 11 is a principal schematic drawing of an inkjet recording apparatus according to a further embodiment of the present invention.

FIG. 11 is a partial compositional diagram of an inkjet recording apparatus 210 which forms a further embodiment of the image forming apparatus according to the present invention. Rather than forming an image directly onto a recording medium, the inkjet recording apparatus 210 shown in FIG. 11 is an image forming apparatus which forms an image temporarily onto an intermediate transfer body 212, and then forms a final image by transferring this image onto the recording medium 16, in a transfer unit 214. In FIG. 11, parts which are the same as or similar to those in FIG. 1 are denoted with the same reference numerals and description thereof is omitted here.

In the inkjet recording apparatus 210 shown in FIG. 11, an endless belt member is used as the intermediate transfer body 212. The intermediate transfer body 212 formed by this endless belt member is wound around tensioning rollers 218 and 219 and opposing rollers 220 and 221 for transfer pressurization, in such a manner that at least the region of the belt surface opposing the nozzle surface of the heads 11, 12K, 12M, 12C and 12Y, and the sensor surface of the print determination unit 24, forms a horizontal surface (flat surface).

In this mode, a test pattern (similar to FIG. 8) is printed onto the intermediate transfer body 212, and the test pattern on the intermediate transfer body 212 is determined by the print determination unit 24. As shown in FIG. 11, the print determination unit 24, the determination light source 26 and the heating and drying unit 28 are provided along the belt surface of the intermediate transfer body 212 having this horizontal surface.

The transfer section 214 is disposed on the opposite side of the image forming surface of the flat intermediate transfer body 212 (a position directly below same in FIG. 11), with respect to the nozzle surfaces of the heads 11, 12K, 12M, 12C and 12Y, and the sensor surface of the print determination unit 24. A belt pressurization and conveyance mechanism 236 including an endless belt member 234 wound around pressurization rollers 230 and 231 and a tensioning roller 232 is provided in the transfer unit 214.

A color image (primary image) formed on the intermediate transfer body 212 by depositing the treatment liquid and the inks from the heads 11, 12C, 12M, 12Y and 12K moves in the counter-clockwise direction in FIG. 11 as the intermediate transfer body 212 is conveyed.

The recording medium 16 is conveyed in synchronism with the conveyance of the intermediate transfer body 212. The intermediate transfer body 212, the recording medium 16 and the belt member 234 become nipped in the transfer unit 214 between the pressurization rollers 230 and 231 of the belt pressurization and conveyance mechanism 236 and the opposing rollers 220 and 221, which oppose the rollers 230 and 231. Therefore, a prescribed pressure (nip pressure) is applied to the intermediate transfer body 212, the recording medium 16 and the belt member 234, thereby causing the primary image on the intermediate transfer body 212 to be transferred onto the recording medium 16.

In this way, an image (secondary image) is transferred onto the recording medium 16 by passing through the transfer unit 214, and the printed object thus generated (the recording medium 16 formed with the image) is outputted from a print output section (not shown).

As shown in the embodiment in FIG. 11, the present invention may also be applied to the inkjet recording apparatus based on the intermediate transfer system.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ink ejection device which ejects ink through nozzles, the ink containing coloring material;

a treatment liquid ejection device which ejects treatment liquid through nozzles, the treatment liquid being a colorless transparent liquid containing no coloring material, the treatment liquid containing infrared-absorbing material and having at least one of an action of insolubilizing the coloring material in the ink when contacting with the ink, an action of aggregating the coloring material in the ink when contacting with the ink, and an action of preventing dispersion of the coloring material in the ink when contacting with the ink;

a test pattern formation control device which controls the treatment liquid ejection device to eject the treatment liquid to form a prescribed test pattern onto one of a recording medium and an intermediate transfer body by depositing the treatment liquid, the prescribed test pattern being formed with only the treatment liquid on which the ink is not superimposed;

an infrared irradiating device which irradiates infrared light onto the treatment liquid having been ejected from the treatment liquid ejection device;

a treatment liquid determination device which includes a photoelectric transducer having sensitivity to the infrared light and determining a formation state of the prescribed test pattern formed with only the treatment liquid on which the ink is not superimposed; and a treatment liquid ejection defect judgment device which judges a number and positions of defective ones of the nozzles of the treatment liquid ejection device according to a determination signal obtained from the photoelectric transducer of the treatment liquid determination device; and an image processing device which specifies a deposition arrangement of the ink in such a manner that usage rate for the nozzle of the ink ejection device corresponding to the position of the defective nozzle of the treatment liquid ejection device is reduced.

2. An image forming apparatus, comprising:

an ink ejection device which ejects ink through nozzles, the ink containing coloring material;

a treatment liquid ejection device which ejects treatment liquid through nozzles, the treatment liquid being a colorless transparent liquid containing no coloring material, the treatment liquid containing infrared-absorbing material and having at least one of an action of insolubilizing the coloring material in the ink when contacting with the ink, an action of aggregating the coloring material in the ink when contacting with the ink, and an action of preventing dispersion of the coloring material in the ink when contacting with the ink;

a test pattern formation control device which controls the treatment liquid ejection device to eject the treatment liquid to form a prescribed test pattern onto one of a recording medium and an intermediate transfer body by depositing the treatment liquid, the prescribed test pattern being formed with only the treatment liquid on which the ink is not superimposed;

an infrared irradiating device which irradiates infrared light onto the treatment liquid having been ejected from the treatment liquid ejection device;

a treatment liquid determination device which includes a photoelectric transducer having sensitivity to the infrared light and determining a formation state of the prescribed test pattern formed with only the treatment liquid on which the ink is not superimposed; and a treatment liquid ejection defect judgment device which judges a number and positions of defective ones of the nozzles of the treatment liquid ejection device according to a determination signal obtained from the photoelectric transducer of the treatment liquid determination device; and a first restoration control device which performs control for carrying out a maintenance operation for restoring ejection performance of the treatment liquid ejection device when the number of the defective nozzles of the treatment liquid ejection device exceeds a first threshold value.

3. The image forming apparatus as defined in claim 2, further comprising:

a recording medium type identification device which identifies a type of the recording medium; and a threshold value setting device which sets the first threshold value according to the type of the recording medium.

4. The image forming apparatus as defined in claim 2, further comprising:

an ink determination device which includes a photoelectric transducer having sensitivity to visible light;

an ink ejection defect judgment device which judges a number and positions of defective ones of the nozzles of the ink ejection device according to a determination signal obtained from the photoelectric transducer of the ink determination device; and a second restoration control device which performs control for carrying out a maintenance operation for restoring ejection performance of the ink ejection device when the number of the defective nozzles of the ink ejection device exceeds a second threshold value smaller than the first threshold value.

5. The image forming apparatus as defined in claim 4, further comprising:

a recording medium type identification device which identifies a type of the recording medium; and a threshold value setting device which sets the first threshold value and the second threshold value according to the type of the recording medium.

* * * * *